US011479434B2

(12) United States Patent
Oshiro et al.

(10) Patent No.: US 11,479,434 B2
(45) Date of Patent: Oct. 25, 2022

(54) SHEET CONVEYING DEVICE AND IMAGE PROCESSING APPARATUS HAVING A TRAY RESISTANCE MEMBER

(71) Applicant: TOSHIBA TEC KABUSHIKI KAISHA, Tokyo (JP)

(72) Inventors: Toshiaki Oshiro, Izu Shizuoka (JP); Isao Yahata, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 155 days.

(21) Appl. No.: 16/984,309

(22) Filed: Aug. 4, 2020

(65) Prior Publication Data

US 2022/0041395 A1 Feb. 10, 2022

(51) Int. Cl.
*B65H 31/10* (2006.01)
*B65H 29/04* (2006.01)

(52) U.S. Cl.
CPC ..... *B65H 31/10* (2013.01); *B65H 29/044* (2013.01); *B65H 2801/06* (2013.01)

(58) Field of Classification Search
CPC ..... B65H 31/10; B65H 29/044; B65H 29/02; B65H 1/08; B65H 1/12; B65H 1/14; B65H 2405/113; B65H 2405/1111; B65H 2405/10; B65H 2405/20; B65H 2405/1132; B65H 2405/1134; B65H 2301/433; H04N 1/0062; H04N 1/00602; H04N 1/0057
See application file for complete search history.

(56) References Cited

U.S. PATENT DOCUMENTS 6,332,609 B1 * 12/2001 Arakawa ..... B65H 1/04 271/157
7,677,550 B2 3/2010 Okazaki
2006/0197276 A1 * 9/2006 Tanaka ..... B65H 1/14 271/118
2009/0243184 A1 * 10/2009 Asada ..... B65H 1/04 271/3.14

* cited by examiner

*Primary Examiner* — Jennifer Bahls
*Assistant Examiner* — Quang X Nguyen
(74) *Attorney, Agent, or Firm* — Amin, Turocy & Watson LLP

(57) ABSTRACT

According to one embodiment, the sheet conveying device includes a tray, an elevating mechanism, a conveyance roller, and a resistance member. The tray stacks a plurality of sheets. The elevating mechanism lifts and lowers the tray in the stacking direction of a plurality of sheets. The conveyance roller conveys the plurality of sheets in the conveyance direction from the upper side in the stacking direction. The resistance member comes into contact with the leading ends of the plurality of sheets in the conveyance direction. The resistance member imparts a sliding resistance larger than that of the sheet stacking surface of the tray to the leading ends of the plurality of sheets that are lifted and lowered by the elevating mechanism.

20 Claims, 22 Drawing Sheets

SHEET CONVEYING DEVICE AND IMAGE PROCESSING APPARATUS HAVING A TRAY RESISTANCE MEMBER

FIELD

Embodiments described herein relate generally to a sheet conveying device and an image processing apparatus.

BACKGROUND

The image processing apparatus includes a sheet conveying device that can stack a plurality of sheets. The plurality of sheets may have high adhesion in the stacking direction due to, for example, the storage environment. If the adhesion between the sheets is too high, double feeding is likely to occur when the sheets are conveyed.

In order to prevent double feeding, the user may have to separate multiple sheets before placing the sheets on the sheet conveying device.

DETAILED DESCRIPTION

Figure 1:
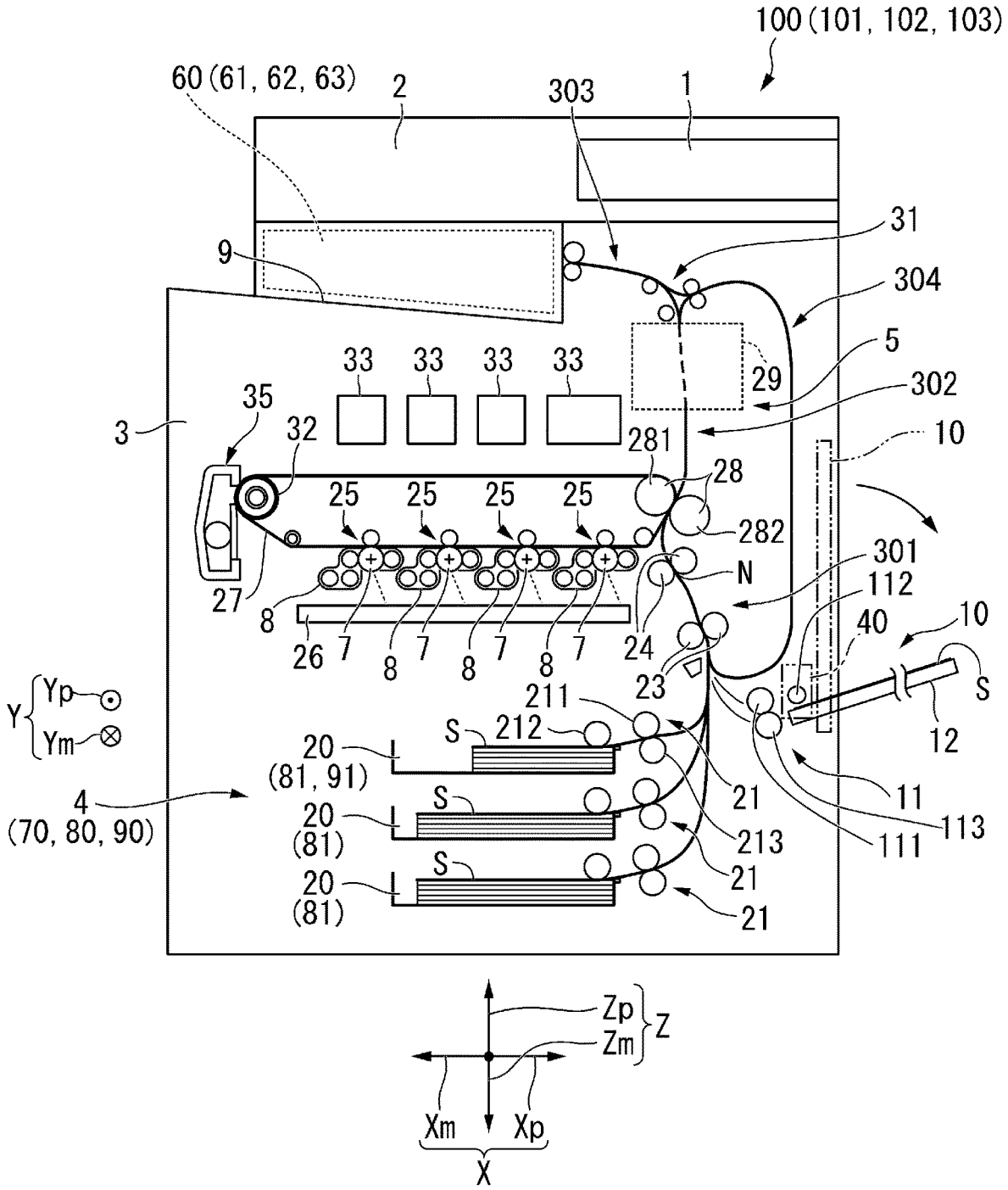
FIG. 1 is a schematic diagram illustrating a configuration example of an image processing apparatus according to a first embodiment.

In general, according to one embodiment, the sheet conveying device includes a tray, an elevating mechanism, a conveyance roller, and a resistance member. The tray stacks a plurality of sheets. The elevating mechanism lifts and lowers the tray in the stacking direction of a plurality of sheets. The conveyance roller conveys the plurality of sheets in the conveyance direction from the upper side in the stacking direction. The resistance member comes into contact with the leading ends of the plurality of sheets in the conveyance direction. The resistance member imparts a sliding resistance larger than that of the sheet stacking surface of the tray to the leading ends of the plurality of sheets that are lifted and lowered by the elevating mechanism. According to another embodiment, sheet conveying method involves lifting and lowering a tray configured to accommodate a stack of a plurality of sheets in a stacking direction of the plurality of sheets using an elevating mechanism; conveying one sheet at a time from the plurality of sheets in the conveyance direction from the upper side in the stacking direction; and contacting a resistance member with a leading end of the plurality of sheets in the conveyance direction and imparting a sliding resistance larger than a sliding resistance of a sheet stacking surface of the tray to the leading ends of the plurality of sheets that are lifted and lowered by the elevating mechanism.

Hereinafter, a sheet conveying device and an image processing apparatus according to embodiments will be described with reference to the drawings. In the following respective drawings, the same or corresponding components are denoted by the same reference numerals unless otherwise specified. Examples of the configurations corresponding to each other include configurations having plane symmetry with respect to an appropriate plane.

First Embodiment

The sheet conveying device and the image processing apparatus according to the first embodiment will be described.

FIG. 1 is a schematic diagram showing a configuration example of an image processing apparatus according to an embodiment.

As shown in FIG. 1, an image processing apparatus 100 according to the present embodiment includes a control panel 1, a scanner unit 2, a printer unit 3, a sheet supply unit 4, a conveyance unit 5, a manual feed unit 10 (sheet conveying device), and a control circuit 60.

Hereinafter, when referring to the relative position in the image processing apparatus 100, the Xp direction, the Xm direction, the Yp direction, the Ym direction, the Zp direction, and the Zm direction shown in the drawing may be used. The Xp direction is a direction from left to right when standing in the front of the image processing apparatus 100 (on the front side of the paper surface of FIG. 1). The Xm direction is opposite to the Xp direction. The Yp direction is a direction from the back surface to the front surface of the image processing apparatus 100. The Ym direction is opposite to the Yp direction. The Zp direction is a vertically upward direction. The Zm direction is a vertically downward direction. When the directions of the Xp (Yp, Zp) direction and the Xm (Ym, Zm) direction do not matter or both directions are included, they are simply referred to as the X (Y, Z) direction.

Hereinafter, a plane having a normal line in the X direction is called a YZ plane, a plane having a normal line in the Y direction is called a ZX plane, and a plane having a normal line in the Z direction is called an XY plane. The ZX plane is parallel to the sheet S conveyance direction described later in the image processing apparatus 100. The XY plane is a horizontal plane.

The control panel 1 operates the image processing apparatus 100 by a user's operation.

The scanner unit 2 reads the image information of the object to be copied based on brightness and darkness of light. The scanner unit 2 outputs the read image information to the printer unit 3.

The printer unit 3 forms an image on a sheet S based on image information from the scanner unit 2 or the outside.

The printer unit 3 forms an output image (toner image) with a developer containing toner. The printer unit 3 transfers the toner image onto the surface of the sheet S. The printer unit 3 applies heat and pressure to the toner image on the surface of the sheet S to fix the toner image on the sheet S.

The sheet supply unit 4 supplies the sheets S one by one to the printer unit 3 at the timing when the printer unit 3 forms a toner image.

The sheet supply unit 4 includes a plurality of sheet feed cassettes 20 and a plurality of cassette sheet feed units 21.

The plurality of sheet feed cassettes 20 accommodate sheets S of various sizes. In the example shown in FIG. 1, the plurality of sheet feed cassettes 20 are provided in three stages.

The plurality of cassette sheet feed units 21 are arranged above the ends of each sheet feed cassette 20 in the Xp direction. Each cassette sheet feed unit 21 includes a pickup roller 212 (conveyance roller), a sheet feed roller 211, and a separation roller 213.

The pickup roller 212 conveys the sheet S required for image formation from the sheet feed cassette 20 to the nip portion between the sheet feed roller 211 and the separation roller 213. The pickup roller 212 is an example of a conveyance roller that conveys the plurality of sheets S in the conveyance direction from the upper side in the stacking direction.

The sheet feed roller 211 conveys the sheet S conveyed to the nip portion to the conveyance unit 5.

The separation roller 213 separates one sheet S when a plurality of sheets S are conveyed.

The conveyance unit 5 includes conveyance rollers 23 and registration rollers 24. The conveyance unit 5 conveys the sheet S supplied from the sheet supply unit 4 to the registration rollers 24.

The registration rollers 24 convey the sheet S at the timing when the printer unit 3 transfers the toner image onto the sheet S.

The conveyance rollers 23 abut the leading end of the sheet S in the conveyance direction against the nip N of the registration rollers 24. The conveyance rollers 23 adjust the position of the leading end of the sheet S in the conveyance direction by bending the sheet S.

The registration rollers 24 align the leading end of the sheet S delivered from the conveyance roller 23 at the nip N. Further, the registration roller 24 conveys the sheet S to a transfer unit 28 side described later.

The conveyance unit 5 has conveyance paths 301, 302, 303, and 304. The conveyance paths 301, 302, 303, and 304 will be described after the other configurations of the printer unit 3 are described.

The printer unit 3 includes a plurality of image forming units 25, a plurality of exposure units 26, an intermediate transfer belt 27, the transfer unit 28, a fixing device 29, and a transfer belt cleaning unit 35.

Four of the plurality of image forming units 25 are arranged in the Xp direction.

Each of the plurality of image forming units 25 forms a toner image to be transferred onto the sheet S on the intermediate transfer belt 27.

Each of the plurality of image forming units 25 includes a photosensitive drum 7. The plurality of image forming units 25 form yellow, magenta, cyan, and black toner images on the respective photosensitive drums 7.

A charger, a developing device 8, a primary transfer roller, a cleaning unit, and a charge eliminator are arranged around each photosensitive drum 7. The primary transfer roller faces the photosensitive drum 7. The intermediate transfer belt 27 is sandwiched between the primary transfer roller and the photosensitive drum 7. An exposure unit 26 is arranged below the charger and the developing device 8.

A toner cartridge 33 is arranged above each image forming unit 25. Each toner cartridge 33 stores a different color of toner. The four toner cartridges 33 contain yellow, magenta, cyan, and black toners, respectively.

The toner in each toner cartridge 33 is supplied to the image forming unit 25 below each by a toner replenishing pipe (not shown).

The exposure section 26 irradiates the surface of each charged photosensitive drum 7 with laser light. The emission of the laser light is controlled based on the image information. The exposure unit 26 can also be configured to emit LED light instead of laser light. In the example shown in FIG. 1, the exposure unit 26 is arranged below the plurality of image forming units 25.

Image information corresponding to yellow, magenta, cyan, and black is supplied to the exposure unit 26.

The exposure unit 26 forms an electrostatic latent image on the surface of each photosensitive drum 7, based on the image information.

The intermediate transfer belt 27 is an endless belt. Tension is applied to the intermediate transfer belt 27 by a plurality of rollers abutting on the inner peripheral surface. The intermediate transfer belt 27 is stretched flat. The inner peripheral surface of the intermediate transfer belt 27 comes into contact with a support roller 281 at the most distant position in the Xp direction in the stretching direction. The inner peripheral surface of the intermediate transfer belt 27 comes into contact with a transfer belt roller 32 at the most distant position in the Xm direction in the stretching direction.

The support roller 281 forms a part of the transfer unit described later. The support roller 281 guides the intermediate transfer belt 27 to the secondary transfer position.

The transfer belt roller 32 guides the intermediate transfer belt 27 to the cleaning position.

On the lower surface side of the intermediate transfer belt 27 in the drawing, each image forming unit 25 except the primary transfer roller is arranged in the Xp direction. The image forming units 25 are arranged in a region between the transfer belt roller 32 and the support roller 281 with a space therebetween.

A transfer bias is applied to the primary transfer roller of each image forming unit 25 when the toner image reaches the primary transfer position. Each primary transfer roller transfers the toner image on the surface of each photosensitive drum 7 onto the intermediate transfer belt 27 (primary transfer).

On the intermediate transfer belt 27, the transfer unit 28 is arranged at a position that is closest to the image forming unit 25 in the Xp direction.

The transfer unit 28 includes the support roller 281 and a secondary transfer roller 282. The secondary transfer roller 282 and the support roller 281 sandwich the intermediate transfer belt 27. The position where the secondary transfer roller 282 and the intermediate transfer belt 27 contact each other is the secondary transfer position.

The transfer unit 28 transfers the charged toner image on the intermediate transfer belt 27 onto the surface of the sheet S at the secondary transfer position. The transfer unit 28 applies a transfer bias to the secondary transfer position. The transfer unit 28 transfers the toner image on the intermediate transfer belt 27 to the sheet S by the transfer bias.

The fixing device 29 applies heat and pressure to the sheet S. The fixing device 29 fixes the toner image transferred to the sheet S by the heat and pressure. The fixing device 29 is arranged above the transfer unit 28.

The transfer belt cleaning unit 35 faces the transfer belt roller 32. The transfer belt cleaning unit 35 sandwiches the intermediate transfer belt 27. The transfer belt cleaning unit 35 scrapes off the toner on the surface of the intermediate transfer belt 27.

Conveyance paths 301 and 302 for conveying the sheet S from the lower side to the upper side are formed in this order between the registration rollers 24 and the transfer unit 28 and between the transfer unit 28 and the fixing unit 29. A conveying path 303 for horizontally discharging the sheet S is formed between the fixing device 29 and the sheet discharge port.

Above the fixing device 29, a conveyance direction switching unit 31 that switches the conveyance direction of the sheet S is provided.

A conveyance path 304 that conveys the sheet S from the conveyance direction switching unit 31 on the fixing device 29 to the registration rollers 24 is formed inside the printer unit 3 on the Xp direction side from the conveyance paths 301 and 302. The conveyance path 304 is used, for example, to reverse the sheet S having an image formed on the surface thereof and feed the sheet to the registration rollers 24 when performing double-sided printing.

Each of the conveyance paths 301, 302, 303, and 304 includes conveyance guide units that face each other with the sheet S sandwiched therebetween, and a conveyance roller that is provided as necessary.

The manual feed unit 10 supplies the sheet S on which an image is formed to the printer unit 3. The manual feed unit 10 is an example of a sheet conveying device.

The manual feed unit 10 includes a manual sheet feed unit 11, a manual feed tray 12, and an elevating mechanism 40.

The manual feed tray 12 is rotatable around an axis extending in the Y direction. When the manual feed tray 12 is used, as indicated by the solid line, the manual feed tray 12 is rotated clockwise when viewed from the Ym direction and opened. Sheets S of various sizes can be placed on the opened manual feed tray 12.

When the manual feed tray 12 is not used, the manual feed tray 12 is accommodated on the side of the printer unit 3 in the Xp direction by being rotated counterclockwise in the drawing, as indicated by the chain double-dashed line.

The manual sheet feed unit 11 separates and feeds the sheet S placed on the manual feed tray 12 and conveys the sheet S toward the registration rollers 24.

The manual sheet feed unit 11 includes a pickup roller 112 (conveyance roller), a sheet feed roller 111, and a separation roller 113.

The pickup roller 112, the sheet feed roller 111, and the separation roller 113 have the same configurations as the pickup roller 212, the sheet feed roller 211, and the separation roller 213 in the cassette sheet feed unit 21.

The pickup roller 112 is an example of a conveyance roller that conveys the plurality of sheets S in the conveyance direction from the upper side in the stacking direction.

Next, the detailed configuration of the manual feed tray 12 will be described.

Figure 2:
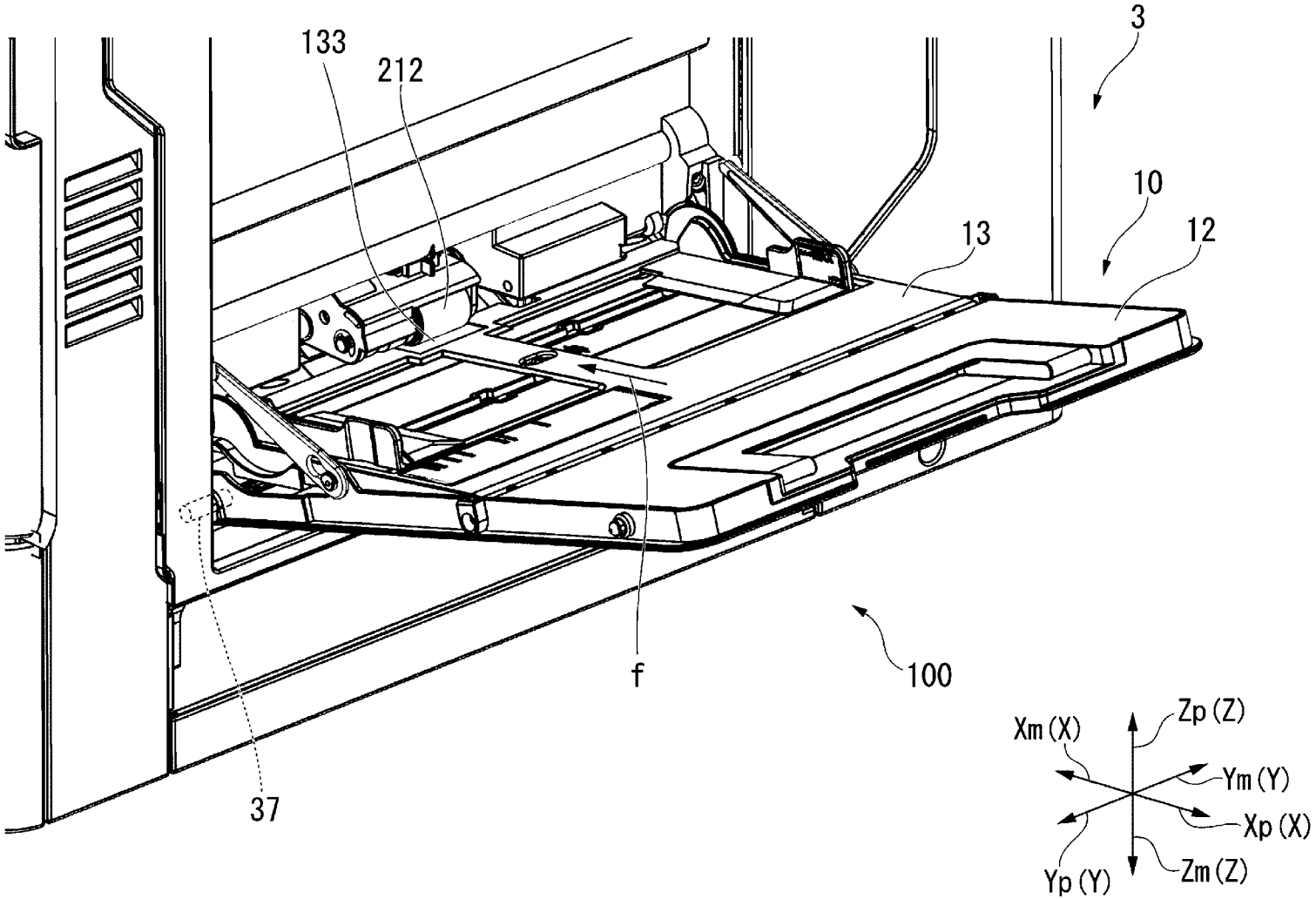
FIG. 2 is a schematic perspective view showing a manual feed tray (lifted position)
Figure 3:
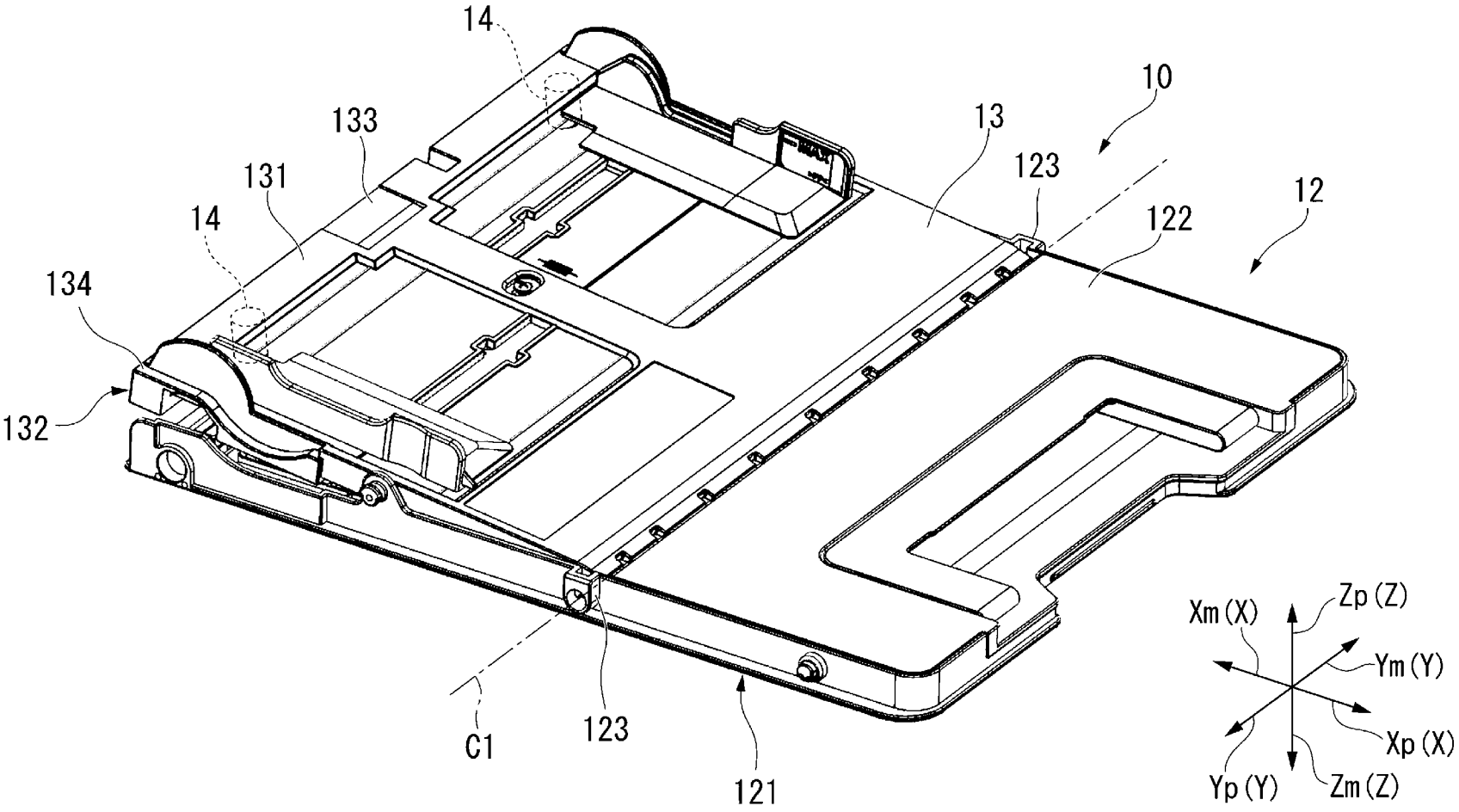
FIG. 3 is a schematic perspective view showing the external appearance of the manual feed tray.
Figure 4:
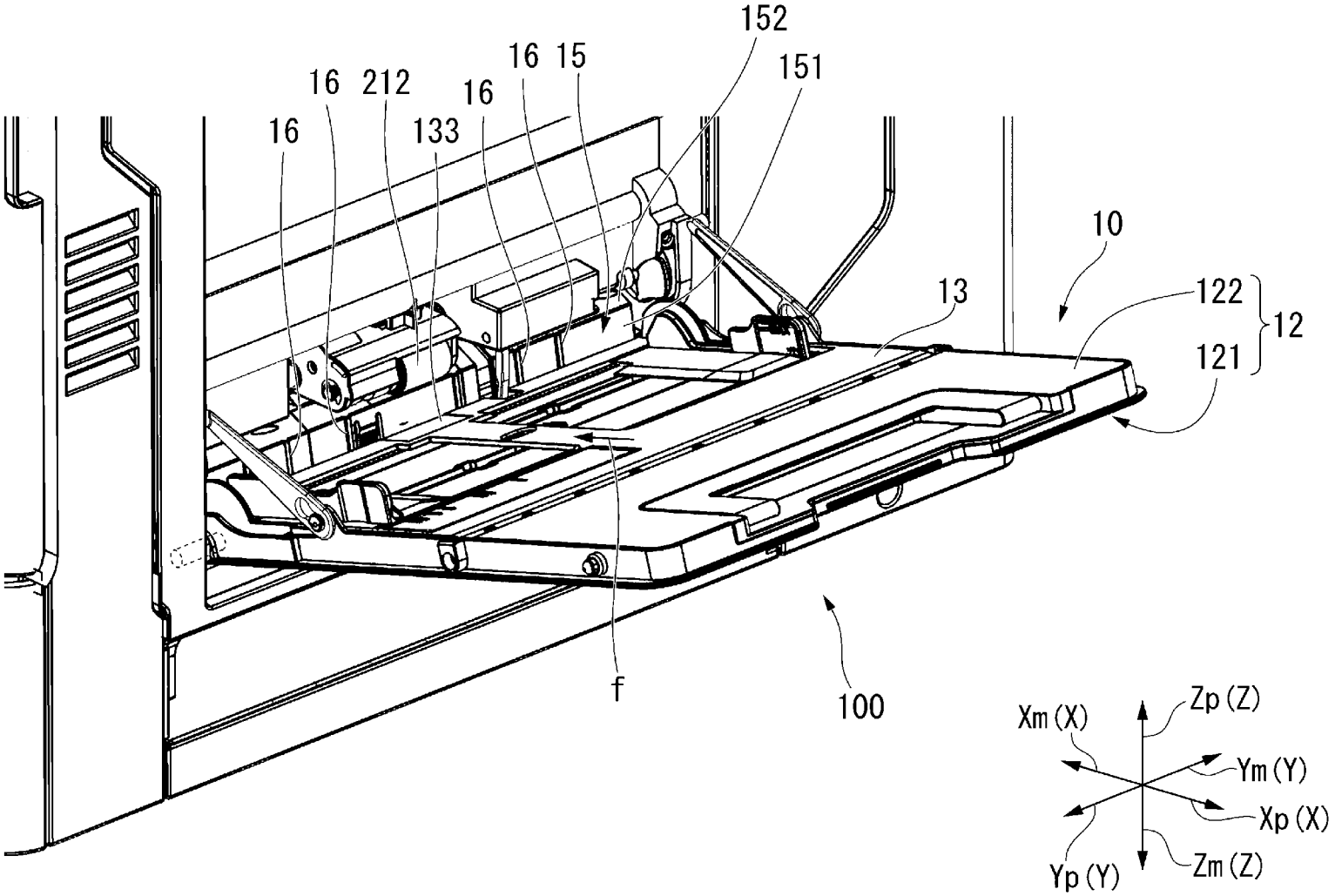
FIG. 4 is a schematic perspective view showing the manual feed tray (first lowered position)

FIG. 2 is a schematic perspective view showing a manual feed tray (lifted position) of the image processing apparatus of the first embodiment. FIG. 3 is a schematic perspective view showing the external appearance of the manual feed tray of the image processing apparatus of the first embodiment. FIG. 4 is a schematic perspective view showing the manual feed tray (first lowered position) of the image processing apparatus of the first embodiment.

As shown in FIG. 2, the manual feed tray 12 has a flat plate shape as a whole. The manual feed tray 12 is rotatably supported by a rotary support shaft 37 provided on the device main body of the printer unit 3. FIG. 2 shows a state in which the manual feed tray 12 is open. The device main body of the printer unit 3 is provided with a manual feed open detection sensor 19 (not shown in FIG. 2, see FIG. 11) that detects that the manual feed tray 12 is open. When the manual feed open detection sensor 19 detects that the manual feed tray 12 is open, the manual feed open detection sensor 19 transmits a detection signal to a control circuit 60 described later.

Unless otherwise specified, the manual feed tray 12 in an open state will be described below.

As shown in FIG. 3, the manual feed tray 12 includes a main body 121, an upper plate 122, an elevating plate 13 (tray), and a biasing member 14.

The main body 121 forms the bottom surface and the side surface of the manual feed tray 12.

The upper plate 122 and the elevating plate 13 are arranged in this order on the upper part of the main body 121 in the Xp direction. The upper plate 122 and the elevating plate 13 form a placement surface on the manual feed tray 12 on which the sheet S is placed. The elevating plate 13 is an example of a tray on which a plurality of sheets are stacked.

In the main body 121, support units 123 that rotatably support the elevating plate 13 are provided on both side surfaces in the Y direction. Each support unit 123 is arranged on the axis C1 extending in the Y direction. Each support unit 123 is provided near the distal end of the upper plate 122 in the Xm direction.

The elevating plate 13 is rotatably engaged with each support unit 123. The elevating plate 13 is rotatable about the axis C1 in the ZX plane.

A flat distal end mounting surface 131 that is long in the Y direction is formed at the distal end of the elevating plate 13 in the Xm direction. A distal end surface 132 extends downward at the end of the distal end mounting surface 131 in the Xm direction.

A friction pad 133 that increases the frictional force against the sheet S is arranged at the center portion of the distal end mounting surface 131 in the longitudinal direction. The friction pad 133 is provided at a position where the friction pad can contact the pickup roller 112 when viewed from the Zm direction. The friction pad 133 is made of a material having a friction coefficient larger than that of the sheets S. The friction pad 133 prevents double feeding of the bottom sheet S placed on the manual feed tray 12.

A cam contact surface 134 is formed outside the distal end mounting surface 131 in the Y direction. However, in FIG. 3, since the Ym-direction cam contact surface 134 is not visible, only the Yp-direction cam contact surface 134 is shown.

A cam plate unit 411 of a pressing member 41, which will be described later, contacts the cam contact surface 134. The shape of the cam contact surface 134 is not particularly limited as long as the elevating plate 13 can be pushed down toward the main body 121 by the pressing force from the cam plate unit 411 described later. In the example shown in FIG. 3, each cam contact surface 134 is a flat surface along the distal end mounting surface 131.

A biasing member 14 is arranged between the back side of the distal end mounting surface 131 and the bottom surface of the main body 121.

The configuration of the biasing member 14 is such that the elevating plate 13 is pushed up in the direction in which the elevating plate 13 is separated from the bottom surface portion of the main body 121. For example, as the biasing member 14, an appropriate spring or elastic member may be used.

In the present embodiment, a compression coil spring is used as the biasing member 14. The biasing members 14 are arranged below the distal end mounting surface 131 and near both ends in the Y direction.

The magnitude of the biasing force of the biasing member 14 is such that the uppermost sheet S abuts the pickup roller 112 and the frictional force capable of feeding the uppermost sheet S can be generated between the uppermost sheet S and the pickup roller 112 when the stackable sheets S are set on the elevating plate 13.

With such a configuration, in the manual feed tray 12 alone, the distal end portion in the Xm direction of the elevating plate 13 biased by the biasing member 14 protrudes above the main body 121. When an external force is applied to each cam contact surface 134 toward the bottom surface portion of the main body 121, the elevating plate 13 descends toward the bottom surface. At the lowermost position of the elevating plate 13, the upper surface of the elevating plate 13 is flush with the upper plate 122.

The arrangement of the elevating plate 13 lowered to the lowest position is called a first lowered position. FIG. 4 shows the manual feed tray 12 in which the elevating plate 13 is moved to the first lowered position.

The arrangement in which the end of the elevating plate 13 in the Xm direction is higher than the first lowered position with respect to the main body 121 is called a lifted position. In the manual feed tray 12 alone shown in FIG. 3, the maximum height of the elevating plate 13 is higher than the height from the bottom surface portion of the main body 121 to the pickup roller 112 in the state of being attached to the printer unit 3. As shown in FIG. 2, the lifted friction pad 133 comes into contact with the pickup roller 112 in the state of being attached to the printer unit 3. Therefore, the lifted position of the elevating plate 13 is limited to the lower side of the position where the friction pad 133 contacts the lower end of the pickup roller 112. Hereinafter, the position of the elevating plate 13 where the friction pad 133 contacts the lower end of the pickup roller 112 is referred to as the uppermost position.

In the manual feed tray 12 in the opened state, the elevating plate 13 is normally arranged at the first lowered position by the elevating mechanism 40 described later. At this time, the user can place the sheet S on the elevating plate 13 and the upper plate 122 of the manual feed tray 12. For example, the sheet S can be placed up to a thickness corresponding to the distance from the friction pad 133 in the lowered position to the lower end of the pickup roller 112.

The conveyance direction f of the sheet S in the manual feed unit 10 is a direction of advancing in the Xm direction along the upper surface of the elevating plate 13 on which the sheet S is placed.

As shown in FIG. 1, the elevating mechanism 40 is provided in the device main body of the printer unit 3.

The elevating mechanism 40 switches the elevating plate 13 between the first lowered position and the lifted position in the manual feed tray 12 in the opened state.

Figure 5:
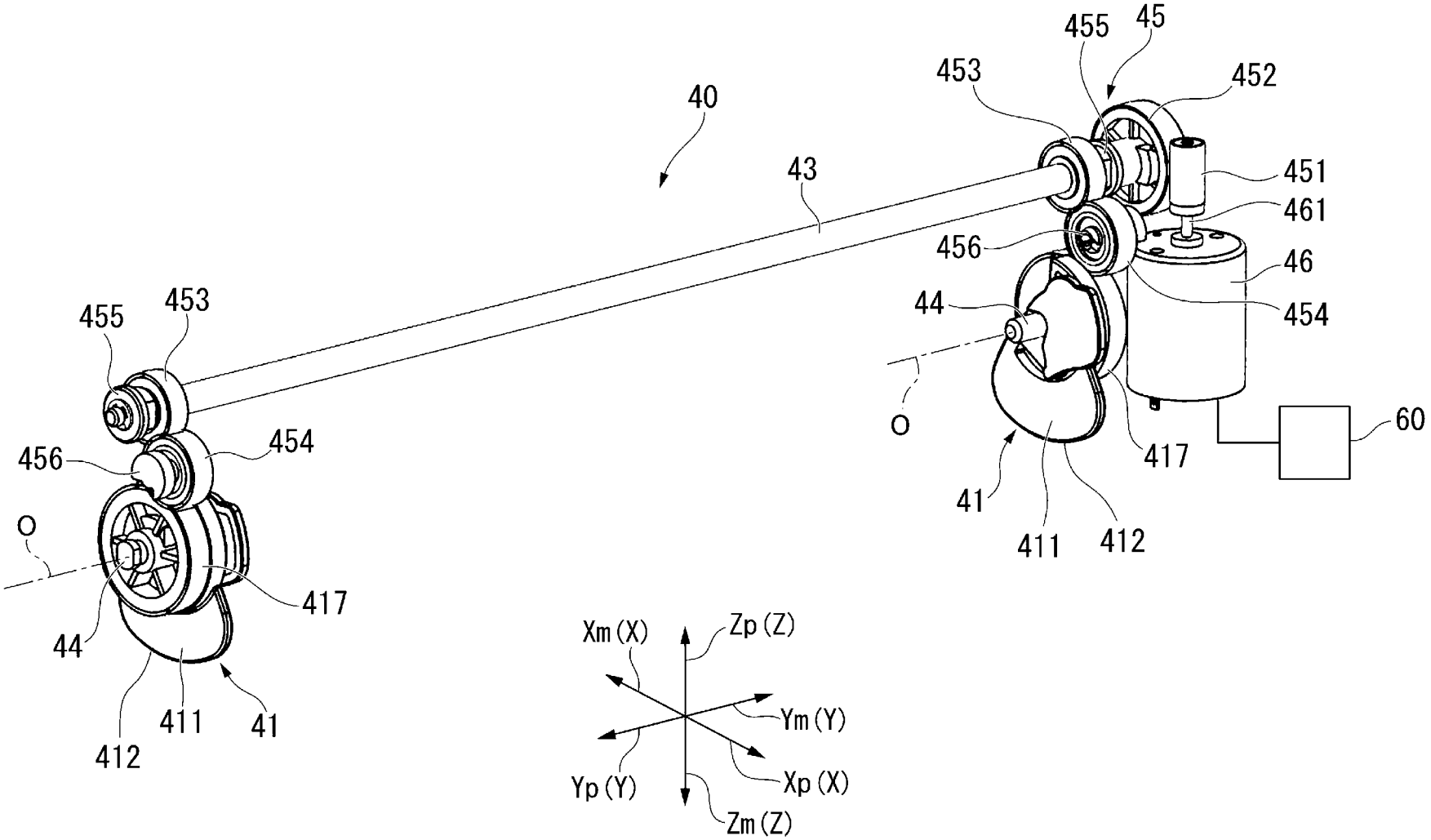
FIG. 5 is a schematic perspective view showing a configuration example of an elevating mechanism.

FIG. 5 is a schematic perspective view showing a configuration example of the elevating mechanism in the image processing apparatus of the first embodiment.

As shown in FIG. 5, the elevating mechanism 40 includes the pressing member 41, a drive motor 46, and a drive transmission unit 45.

The pressing member 41 abuts each cam contact surface 134 (see FIG. 7, not shown in FIG. 5) of the elevating plate 13 to regulate the height of the elevating plate 13. The pressing member 41 is provided above each cam contact surface 134.

Each pressing member 41 has a shape that is plane-symmetric to the ZX plane at the center of each arrangement position. Hereinafter, an example of the pressing member 41 in the Ym direction will be described. Regarding the shape of the pressing member 41 in the Yp direction, the Yp direction may be read as the Ym direction in the description of the pressing member 41 below.

The pressing member 41 includes a gear unit 417 and a cam plate unit 411.

The gear unit 417 receives a driving force from the drive transmission unit 45 described later. For example, the gear unit 417 is a spur gear. A rotation support shaft 44 is inserted in the center portion of the gear unit 417. In the center portion of the gear unit 417, a bearing that allows the rotation support shaft 44 to be rotatably inserted is provided. The gear unit 417 can rotate around the central axis 0 of the rotation support shaft 44.

The cam plate unit 411 extends radially outward from the center portion of the gear unit 417 and has a distal end protruding radially outward from the gear unit 417. An end surface of the cam plate unit 411 that protrudes radially outward of the gear unit 417 is a cam surface 412 that presses the cam contact surface 134 downward.

The drive motor 46 is a motor that supplies a rotational driving force to the drive transmission unit 45 described later by the rotation of a motor shaft 461. The drive motor 46 is fixed to the device main body on the rear side of the printer unit 3 via a support member (not shown).

The drive motor 46 and the drive transmission unit 45 are used to swing the pressing member 41. The drive motor 46 is communicatively connected to the control circuit 60. For example, as the drive motor 46, a motor in which the motor shaft 461 rotates forward and backward is used.

The drive transmission unit 45 transmits the rotation of the motor shaft 461 to the pressing member 41. In the example shown in FIG. 5, the drive transmission unit 45 is a gear transmission mechanism. In the example shown in FIG. 5, the motor shaft 461 extends in the Z direction.

For example, the drive transmission unit 45 includes a first gear 451, a second gear 452, a rotary shaft 43, a third gear 453, and a fourth gear 454.

The first gear 451 is a worm gear fixed coaxially with the motor shaft 461.

The second gear 452 is a worm wheel that meshes with the first gear 451.

The rotary shaft 43 is a rotary shaft that transmits the rotation of the second gear 452. The rotary shaft 43 is rotatably supported by bearings 455 arranged on the front side plate and the rear side plate of the device main body of the printer unit 3.

The third gear 453 and the fourth gear 454 are provided at both ends of the rotary shaft 43. The third gear 453 and the fourth gear 454 transmit the rotation of the rotary shaft 43 to the pressing members 41.

The fourth gear 454 is an idler gear provided in the transmission path between the third gear 453 and the gear unit 417 of the pressing member 41.

According to the drive transmission unit 45 having such a configuration, when the drive motor 46 rotates, the pressing members 41 rotate in synchronization with each other in the same direction. The pressing member 41 swings around the central axis O according to the forward and reverse rotation of the drive motor 46.

Figure 6:
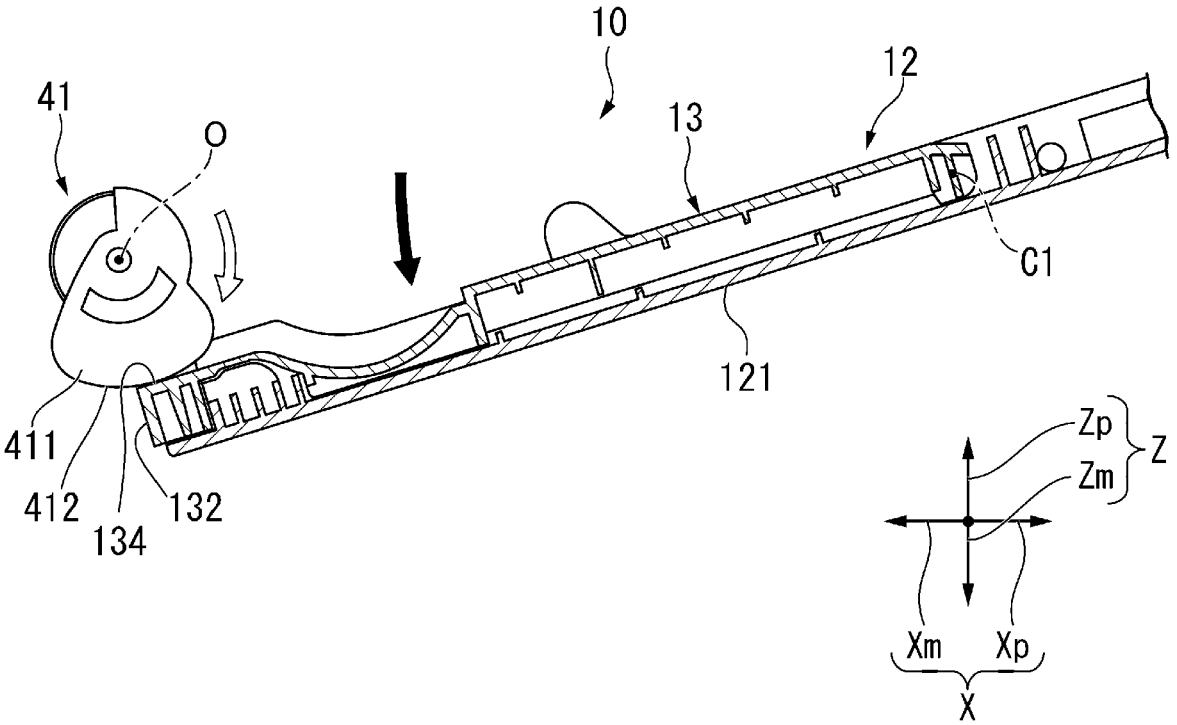
FIG. 6 is a schematic diagram of a cross section showing the manual feed tray at the first lowered position of an elevating plate.
Figure 7:
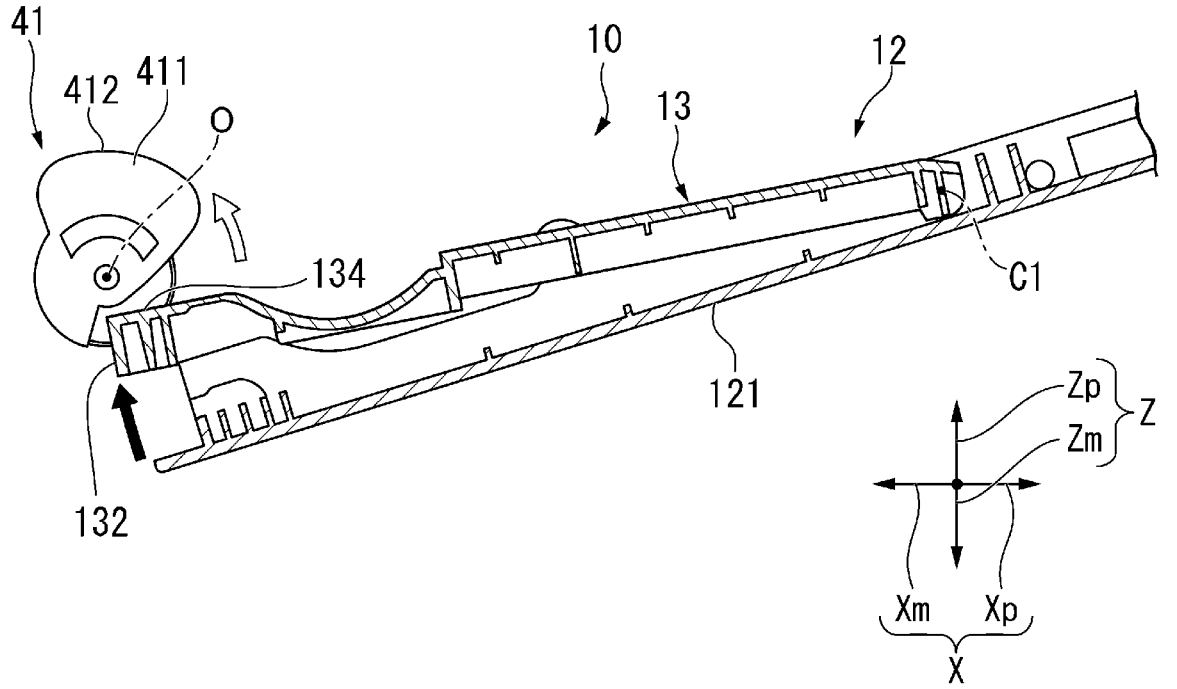
FIG. 7 is a schematic diagram of a cross section showing the manual feed tray at the lifted position of the elevating plate.

FIG. 6 is a schematic diagram of a cross section showing the manual feed tray in the first lowered position of the elevating plate in the image processing apparatus of the first embodiment. FIG. 7 is a schematic diagram of a cross section showing the manual feed tray at the lifted position of the elevating plate in the image processing apparatus of the first embodiment.

As shown in FIG. 6, the cam plate unit 411 faces downward at the most clockwise swing position. The cam plate unit 411 presses the cam contact surface 134 downward. The elevating plate 13 is pushed down to the first lowered position. The swing position is the home position of the pressing member 41. The presence of the pressing member 41 at the home position is detected by a home position detection sensor (not shown).

When the pressing member 41 rotates counterclockwise, the elevating plate 13 ascends according to the shape of the cam surface 412.

As shown in FIG. 7, the cam plate unit 411 faces upward at the most counterclockwise swing position. Since the cam plate unit 411 is separated from the cam contact surface 134, the pressing force from the cam surface 412 is released. The elevating plate 13 is biased by the biasing member 14 (not shown) to ascend to the uppermost position.

The elevating mechanism 40 can lift and lower the elevating plate 13 between the first lowered position and the uppermost position by swinging the pressing member 41 by an appropriate angle.

As shown in FIG. 4, in the device main body of the printer unit 3, a regulation plate 15 that regulates the position in the conveyance direction of the sheet S (not shown) is arranged in the Xm direction from the manual feed unit 10.

Figure 8:
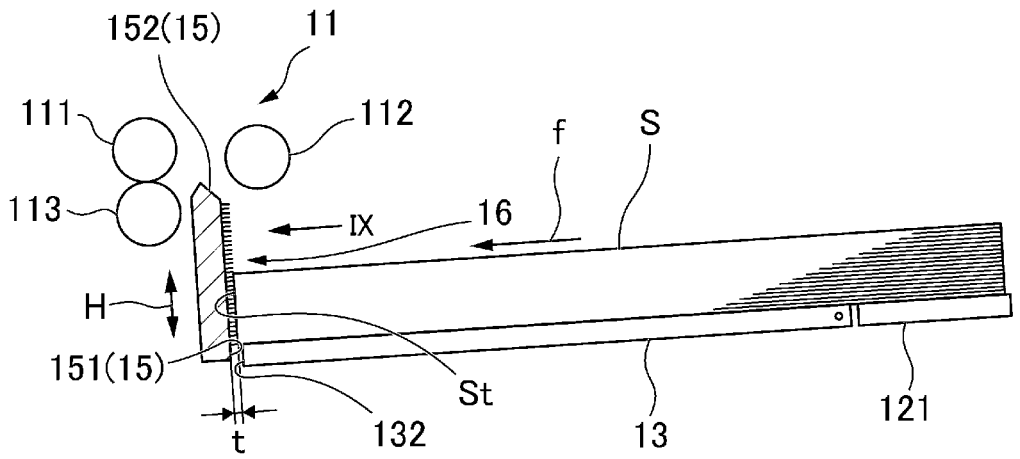
FIG. 8 is a schematic diagram of a cross section showing an example of a manual feed unit.
Figure 9:
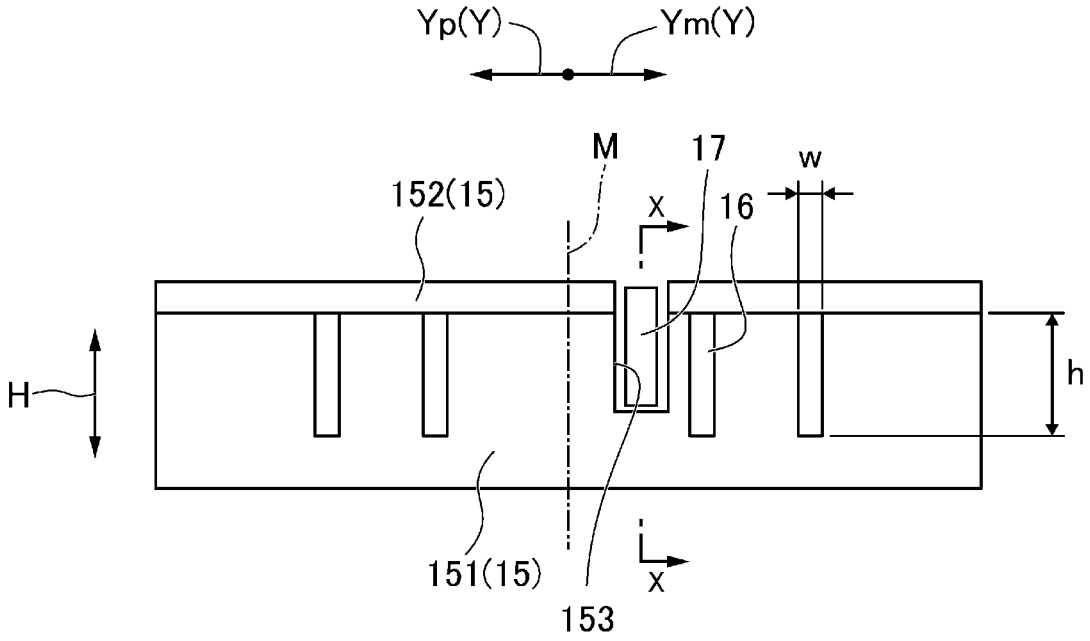
FIG. 9 is a schematic diagram of the IX view in FIG. 8.

FIG. 8 is a schematic diagram of a cross section showing an example of the manual feed unit in the image processing apparatus of the first embodiment. FIG. 9 is a schematic diagram of the IX view in FIG. 8.

As shown in FIG. 8, the regulation plate 15 includes a first regulation surface 151 and a second regulation surface 152.

The first regulation surface 151 is a flat surface that faces the distal end surface 132 of the elevating plate 13 and extends in a direction orthogonal to the upper surfaces of the elevating plate 13 and the upper plate 122 at the first lowered position. The first regulation surface 151 extends from below the upper end of the elevating plate 13 at the first lowered position in the Xm direction to a position slightly lower than the upper end of the elevating plate 13 at the uppermost position in the Xm direction.

The second regulation surface 152 is an inclined surface that extends obliquely upward as advancing in the conveyance direction f from the upper end of the first regulation surface 151. The second regulation surface 152 guides the lower surface of the sheet S conveyed from the manual feed unit 10 from below.

A resistance member 16 is provided on the first regulation surface 151.

The resistance member 16 abuts the leading ends St of the plurality of sheets S in the conveyance direction f and imparts sliding resistance to the leading ends of the plurality of sheets S that are lifted and lowered by the elevating mechanism 40. The sliding resistance applied to the plurality of sheets S by the resistance member 16 is larger than the sliding resistance of the upper surface of the elevating plate 13 which is the sheet stacking surface of the manual feed unit 10.

The method of fixing the resistance member 16 on the first regulation surface 151 is not particularly limited. For example, the resistance member 16 may be attached to the first regulation surface 151 via an adhesive or a pressure-sensitive adhesive.

The material used for the resistance member 16 is not particularly limited as long as the sliding resistance is larger than that of the upper surface of the elevating plate 13. For example, since the upper surface of the elevating plate 13 is made of a smooth metal surface, the resistance member 16 may have a non-smooth surface layer portion.

In the example schematically shown in FIG. 8, the resistance member 16 includes a napped material including a plurality of fibers extending toward the plurality of sheets S in the surface layer portion. For example, the resistance member 16 may be a napped cloth, a brush-shaped flocking member, or the like. When a plurality of sheets S come into contact with such a napped material, fibers of the napped material enter between the sheets S. Therefore, when the plurality of sheets S move in the stacking direction H with respect to the napped material, the sliding resistance increases.

The thickness t of the resistance member 16 is not particularly limited as long as the required sliding resistance can be obtained.

More preferably, the surface layer portion of the resistance member 16 that contacts the sheet S contains a material that does not easily charge the sheet S. For example, more preferably, a part or the whole of the surface layer portion of the resistance member 16 is formed of a conductive material.

A suitable conductive material for the resistance member 16 is, for example, aluminum.

The resistance member 16 may be provided on the entire surface of the first regulation surface 151 or may be provided on a part of the first regulation surface 151.

When the resistance member 16 is provided on a part of the first regulation surface 151, the arrangement position and the number of the resistance member 16 in the Y direction are not particularly limited as long as the required sliding resistance can be imparted to the leading ends St of the sheets S of various sizes that can be conveyed from the manual feed unit 10.

In the example shown in FIG. 9, one resistance member 16 is arranged at each of four positions separated in the Y direction. Each resistance member 16 has a strip shape extending in the stacking direction H of the sheets S. Each resistance member 16 has a length h and a width w (however, w<h) as viewed in the conveyance direction f. The lengths of h and w are not particularly limited as long as the required sliding resistance is obtained.

Since the printer unit 3 conveys the sheet S based on the center, the sheet S is placed on the sheet placing surface so that the center in the width direction is aligned with the conveyance center line Min the manual feed unit 10. Therefore, the resistance members 16 are arranged in line symmetry to the conveyance center line M.

An actuator 17 is arranged in a groove 153 near the conveyance center line M in the regulation plate 15.

Figure 10:
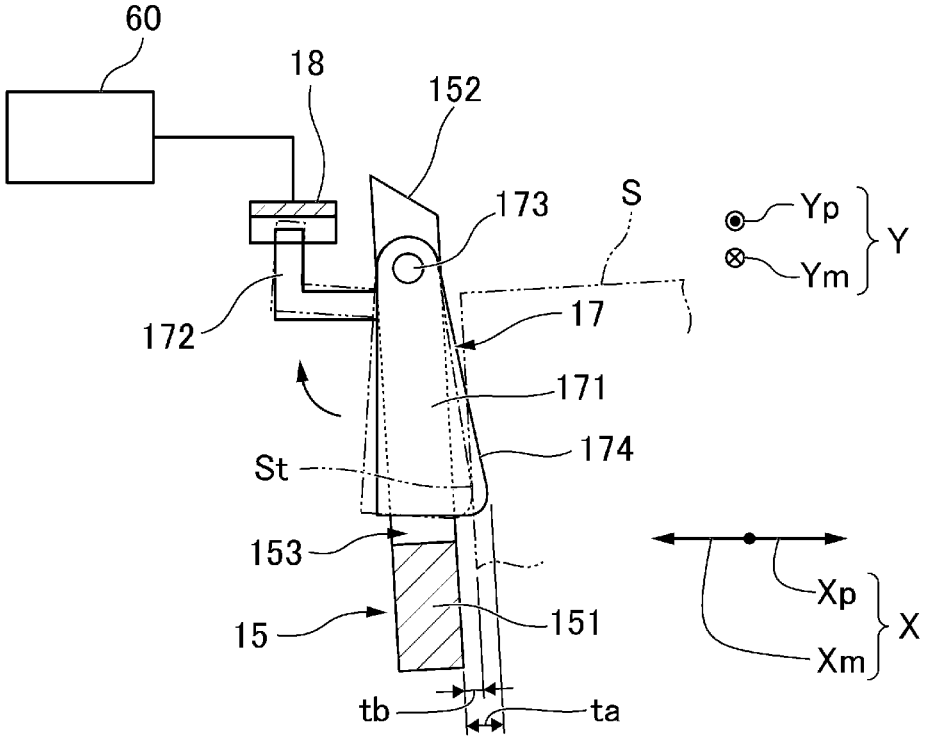
FIG. 10 is a schematic diagram of a cross section taken along line X-X in FIG. 9.

FIG. 10 is a schematic diagram of a cross section taken along line X-X in FIG. 9.

As shown in FIG. 10, the actuator 17 constitutes a sheet detection mechanism that detects that the sheet S is placed, together with a manual feed sheet detection sensor 18.

The actuator 17 includes an actuator body 171 and a light blocking arm 172.

The actuator body 171 is rotatably fixed to a rotation support shaft 173 provided above the groove 153. The actuator body 171 can rotate in the ZX plane about the rotation support shaft 173.

When no external force other than gravity is applied to the actuator body 171, a detection surface 174 formed by the side surface in the Xp direction protrudes in the Xp direction more than the resistance member 16 (see FIG. 8) on the first regulation surface 151. The protrusion amount to of the detection surface 174 from the first regulation surface 151 is larger than the thickness t of the resistance member 16.

When the sheet S is placed on the manual feed tray 12, the leading end St of the sheet S pushes the actuator body 171 in the Xm direction and rotates the actuator body 171 clockwise in the drawing (see the chain double-dashed line). The protrusion amount tb of the detection surface 174 from the first regulation surface 151 is t or less.

The light blocking arm 172 protrudes in an L shape from the side surface of the actuator body 171 in the Xm direction. The light blocking arm 172 rotates in the same direction as the actuator body 171 in conjunction with the actuator body 171.

The manual feed sheet detection sensor 18 detects the presence of the sheet S on the manual feed tray 12 by detecting the rotational position of the light blocking arm 172. For example, as the manual feed sheet detection sensor 18, a photo interrupter in which a light emitting unit and a light receiving unit face each other is used. In the manual feed sheet detection sensor 18, when the height of the detection surface 174 from the first regulation surface 151 is rotated to a position less than the thickness t of the resistance member 16, the light blocking arm is placed in a position blocking the detection light of the photo interrupter.

The manual feed sheet detection sensor 18 is electrically connected to the control circuit 60. The manual feed sheet detection sensor 18 transmits a detection signal to the control circuit 60.

The control circuit 60 controls the entire image processing apparatus 100 and each device part. For example, the control circuit 60 controls the control panel 1, the scanner unit 2, the printer unit 3, the sheet supply unit 4, the conveyance unit 5, and the manual feed unit 10 to convey the sheet S and form an image on the sheet S.

Figure 11:
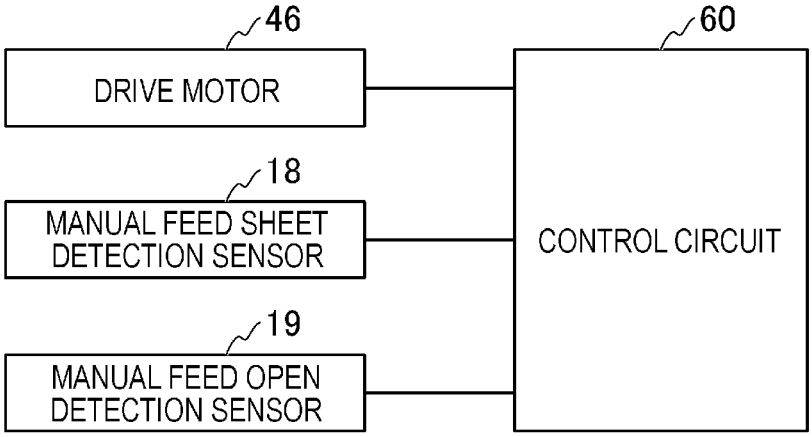
FIG. 11 is a block diagram of a control system.

FIG. 11 is a block diagram of a control system in the image processing apparatus of the first embodiment.

As shown in FIG. 11, the control circuit 60 is electrically connected to the drive motor 46, the manual feed sheet detection sensor 18, and the manual feed open detection sensor 19.

For example, the control circuit 60 transmits a control signal to the drive motor 46 in the manual feed unit 10 to control the elevation of the elevation plate 13. The control circuit 60 lifts and lowers the elevating plate 13. When the elevating plate 13 is lifted and lowered, the leading end St of the sheet S slides on a lens frame 16, so that the plurality of sheets S placed on the manual feed tray 12 are separated.

For example, the control circuit 60 determines whether the manual feed tray 12 is open based on the detection signal from the manual open detection sensor 19. The control circuit 60 determines whether the sheet S is placed on the manual feed tray 12 based on the detection signal from the manual feed sheet detection sensor 18.

As the device configuration of the control circuit 60, for example, a processor such as a central processing unit (CPU) may be used.

Next, the operation of the image processing apparatus 100 will be described focusing on the separating operation on the manual feed tray 12.

First, an outline of the print operation in the image processing apparatus 100 will be briefly described.

In the image processing apparatus 100 shown in FIG. 1, conditions such as the type of the sheet S to be image-formed and the number of prints are set based on the operation of the control panel 1 or an external signal. Image formation is started by the print start signal generated thereafter. The image information is transmitted to the printer unit 3 by reading the object to be copied by the scanner unit 2, or transmitted from the outside to the printer unit 3. The printer unit 3 supplies the sheet S in the sheet supply unit 4 or the sheet S in the manual feed unit 10 to the registration rollers 24 based on the control signal generated by the control circuit 60 in response to the condition setting and the reception of the print start signal. Hereinafter, as an example, a case where the sheet S is supplied from the manual feed unit 10 will be described. The setting of the sheets S in the manual feed unit 10 will be described later.

When the print start signal is received, the control circuit 60 controls the start of sheet feeding from the manual feed unit 10 and image formation.

Each image forming unit 25 forms an electrostatic latent image on each photosensitive drum 7 based on the image information corresponding to each color. Each electrostatic latent image is developed by the developing device 8. Therefore, a toner image corresponding to the electrostatic latent image is formed on the surface of each photosensitive drum 7.

Each toner image is primarily transferred onto the intermediate transfer belt 27 by each transfer roller. As the intermediate transfer belt 27 moves, the toner images are sequentially superposed without causing color misregistration and are sent to the transfer unit 28.

The sheet S is fed from the registration rollers 24 to the transfer unit 28. The toner image reaching the transfer unit 28 is secondarily transferred to the sheet S. The toner image secondarily transferred is fixed to the sheet S by the fixing device 29. As a result, an image is formed on the sheet S.

Next, the operation of the manual feed unit 10 will be described in detail.

Figure 12:
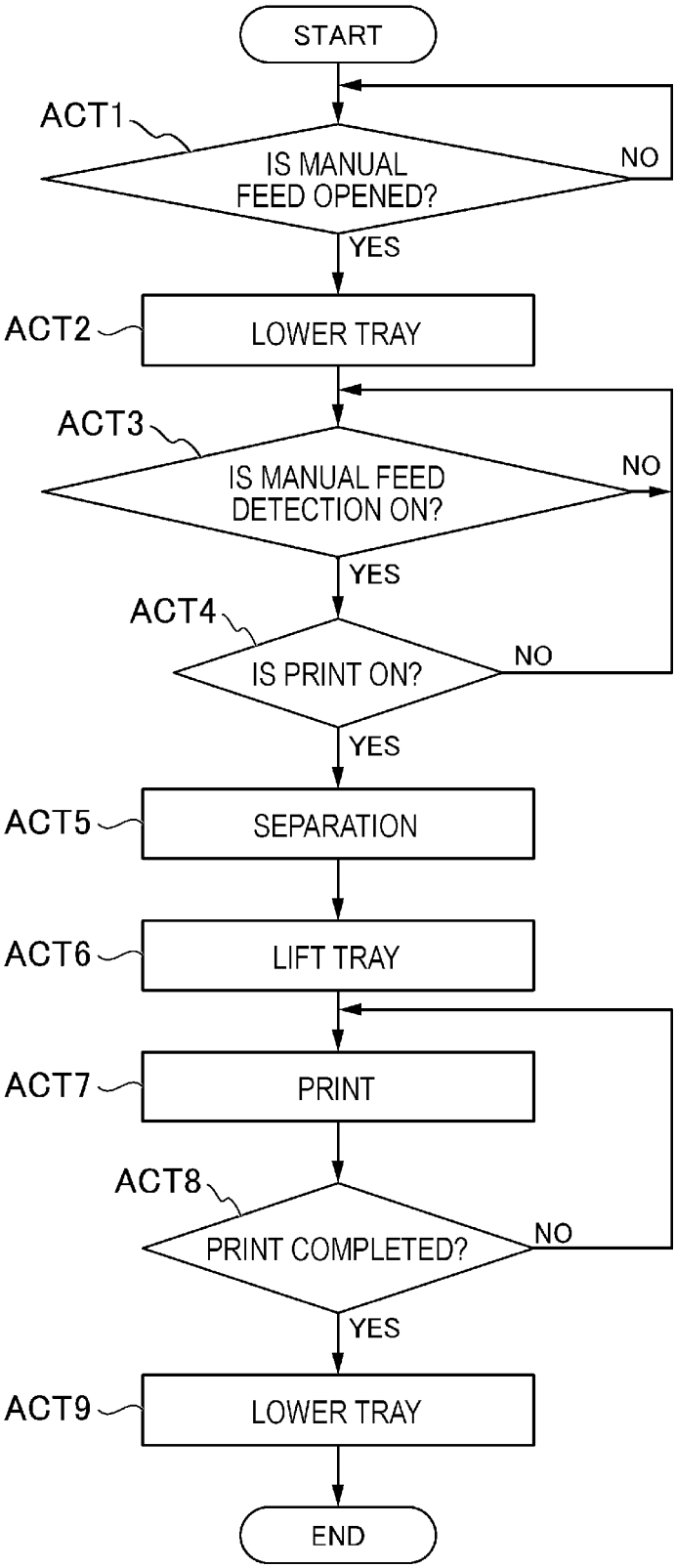
FIG. 12 is a flowchart of an image forming operation by manual sheet feeding.
Figure 13A:
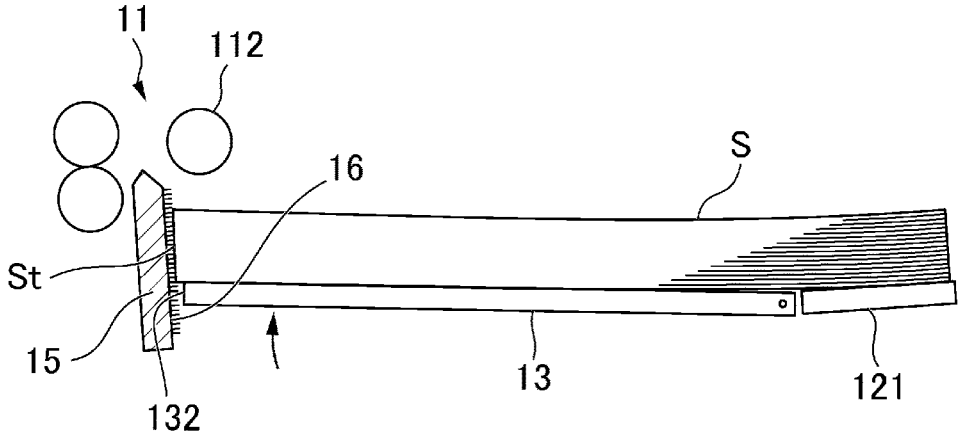
FIG. 13A is an operation explanatory diagram of the manual feed tray.
Figure 13B:
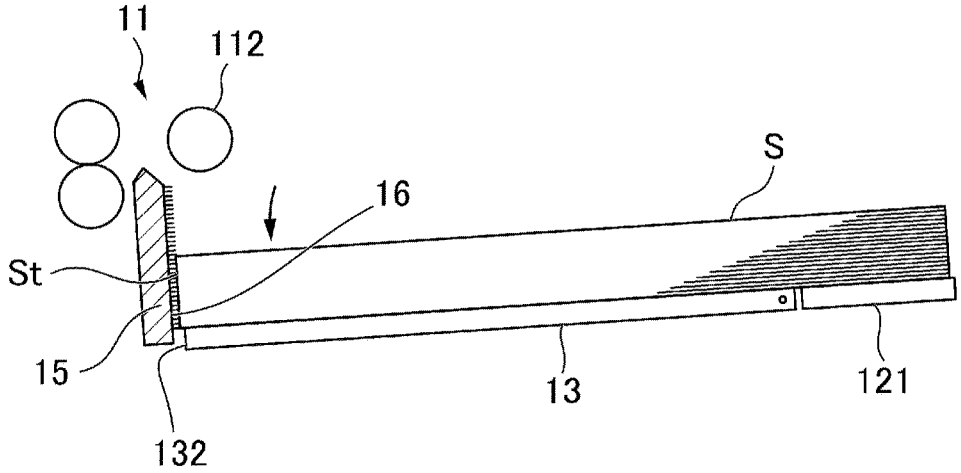
FIG. 13B is an operation explanatory diagram of the manual feed tray.
Figure 13C:
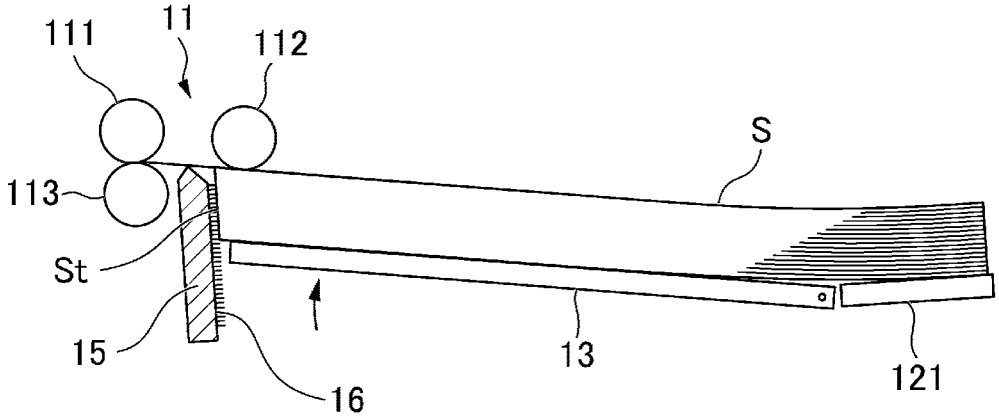
FIG. 13C is an operation explanatory diagram of the manual feed tray.

FIG. 12 is a flowchart of an image forming operation by manual sheet feeding in the image processing apparatus of the first embodiment. FIGS. 13A, 13B, and 13C are operation explanatory diagrams of the manual feed tray in the image processing apparatus of the first embodiment.

In the image processing apparatus 100, when an image is formed using the sheet S on the manual feed tray 12, the control circuit 60 performs the control to execute ACT 1 to ACT 9 shown in FIG. 12.

In ACT 1, the control circuit 60 determines whether the manual feed tray 12 is open based on the detection signal from the manual feed open detection sensor 19.

When a detection signal indicating that the manual feed tray 12 is in the opened state is received from the manual feed open detection sensor 19 (ACT 1: YES), the control circuit 60 executes ACT 2.

When the detection signal indicating that the manual feed tray 12 is in the opened state is not received from the manual feed open detection sensor 19 (ACT 1: NO), the control circuit 60 repeats ACT 1.

In ACT 2, the control circuit 60 transmits a control signal to the elevating mechanism 40 to lower the elevating plate 13 (described as "tray" in FIG. 12) to the first lowered position. The elevating mechanism 40, which received the control signal from the control circuit 60, drives the drive motor 46 to rotate the pressing members 41 clockwise in the drawing as shown in FIG. 6. The cam contact surface 134 of the elevating plate 13 is pressed in the Zm direction by each pressing member 41.

The drive motor 46 is driven until the pressing member 41 reaches the home position. The elevating plate 13 rotates clockwise in the drawing around the axis C1 and descends to the first lowered position.

Since the sheets S can be placed on the elevating plate 13 and the upper plate 122, the user places the required number of sheets S on the elevating plate 13 and the upper plate 122 of the manual feed tray 12.

When the sheet S is placed, as indicated by a chain double-dashed line in FIG. 10, the actuator 17 pushed by the leading end St of the sheet S rotates in the clockwise direction in the drawing around the rotation support shaft 173. When the light blocking arm 172 moves to a position that shields light between the light emitting unit and the light receiving unit of the manual feed sheet detection sensor 18, the manual open detection sensor 19 transmits the detection signal that detects that the sheet S is placed on the manual feed tray 12 to the control circuit 60.

In ACT 3, the control circuit 60 determines whether the sheet S is placed on the manual feed tray 12 based on the detection signal of the manual feed sheet detection sensor 18.

When the detection signal is received from the manual feed sheet detection sensor 18 (ACT 3: YES), the control circuit 60 executes ACT 4.

When the detection signal is not received from the manual feed sheet detection sensor 18 (ACT 3: NO), the control circuit 60 repeats ACT 3.

In ACT 4, the control circuit 60 determines whether the print start signal is received.

When the print start signal is received (ACT 4: YES), the control circuit 60 executes ACT 5.

When the print start signal is not received (ACT 4: NO), the control circuit 60 repeats ACT 3.

In ACT 5, the control circuit 60 transmits a control signal to the elevating mechanism 40 to execute the separation as follows.

The control circuit 60 transmits a control signal to the elevating mechanism 40 to perform at least one elevating operation. In one elevating operation, the elevating mechanism 40 lifts the elevating plate 13 from the first lowered position to a predetermined lifted position (see FIG. 13A) and lowers the elevating plate 13 from the lifted position to the first lowered position (see FIG. 13B).

As shown in FIG. 13A, the predetermined lifted position is a height at which the uppermost sheet S does not come into contact with the pickup roller 112 even when the maximum allowable stacking number of sheets S are placed.

While the elevating plate 13 ascends, the leading end St of the sheet S slides on the resistance member 16 and is pulled downward by the sliding resistance with the resistance member 16. When the fibers of the resistance member 16 enter between the sheets S in the first lowered position, the lower sheet S is pressed by the fibers, so that a gap is generated between the upper sheet S and the lower sheet S. The fibers slipped from between the sheets enter between the sheets S in the lower layer.

As such, the leading ends St of the plurality of sheets S in contact with the resistance member 16 are separated from the upper side to the lower side while the elevating plate 13 is ascending. In the plurality of separated sheets S, since air enters between the sheets in the vicinity of the leading end St, the adhesion force between the sheets S that are in close contact with each other is reduced in the vicinity of the leading ends St.

As shown in FIG. 13B, while the elevating plate 13 descends toward the first lowered position, the leading end St of the sheet S slides on the resistance member 16 and is rolled up by the sliding resistance with the resistance member 16. When the fibers of the resistance member 16 enter between the sheets Sat the lifted position, the upper sheet S is pressed by the fibers, so that a gap is formed between the upper sheet S and the lower sheet S. The fibers slipped from between the sheets enter between the sheets S in the upper layers.

As such, the leading ends St of the plurality of sheets S in contact with the resistance member 16 are separated from the lower side to the upper side while the elevating plate 13 is descending. In the plurality of separated sheets S, since air enters between the sheets in the vicinity of the leading end St, the adhesion force between the sheets S that are in close contact with each other is reduced in the vicinity of the leading ends St.

In particular, when the elevating plate 13 is ascending, the sheets S are repeatedly rolled up by sliding on the resistance member 16 and then dropped downward by gravity. Therefore, the plurality of sheets S are more strongly separated when descending, together with the fact that the plurality of sheets S are separated to some extent when ascending.

When the separation is performed in such manner, frictional charging may occur on the resistance member 16 and the leading end S of the sheet S. If the charge amount of the sheet S is too large, the conveyance may be hindered.

If the material of the resistance member 16 contains a conductive material, the charge of the sheet S is removed, and thus the charge amount of the sheet S can be reduced.

When the elevating operation of the elevating plate 13 is performed a predetermined number of times, ACT 5 ends. After that, the control circuit 60 executes ACT 6.

In ACT 6, the control circuit 60 transmits a control signal to the elevating mechanism 40 to move the elevating plate 13 from the first lowered position to the uppermost position.

The control circuit 60 transmits a control signal to the elevating mechanism 40 to rotate the pressing member 41 to a position where the cam surface 412 is separated from the cam contact surface 134 (see FIG. 7).

The elevating plate 13 is released from the pressing force of the pressing member 41 and is biased upward by the biasing member 14. The elevating plate 13 is lifted to the uppermost position where the uppermost surface of the plurality of sheets S are in contact with the pickup roller 112.

Thus, ACT 6 is completed. After that, the control circuit 60 executes ACT 7.

In ACT 7, the control circuit 60 transmits a control signal to each device part of the image processing apparatus 100 to convey one sheet S from the manual feed tray 12 to the conveyance unit 5 and perform the above-described printing operation.

In the present embodiment, the separation is performed in ACT 5. As shown in FIG. 13C, when the pickup roller 112 feeds the sheet S from the manual feed tray 12, it is possible to prevent the double feeding of three or more sheets S. Even if two sheets S are double-fed, since the manual sheet feed unit 11 includes the separation roller 113, the uppermost one sheet S among the double-fed sheets can be conveyed to the conveyance unit 5.

Thus, ACT 7 is completed. After that, the control circuit 60 executes ACT 8. There may be a gap between adjacent sheets.

In ACT 8, the control circuit 60 transmits a control signal to the elevating mechanism 40 to lower the elevating plate 13 from the uppermost position to the first lowered position.

The control circuit 60 transmits a control signal to the elevating mechanism 40 to move the pressing member 41 to the home position.

The elevating plate 13 moves to the first lowered position, and thus, the user can place the sheet S on the manual feed tray 12 as necessary.

Thus, the image forming operation when the sheet S is fed from the manual feed tray 12 is completed.

According to the image processing apparatus 100 of the present embodiment, since the manual feed unit 10 includes the resistance member 16 and the control circuit 60 that lifts and lowers the elevating plate 13 to perform the separation, it is possible to prevent double feeding in the manual feed unit 10 even if the user does not separate the sheets S before placing the sheets S.

Second Embodiment

A sheet conveying device and an image processing apparatus according to a second embodiment will be described.

As shown in FIG. 1, an image processing apparatus 101 of the present embodiment includes a sheet supply unit 70 (sheet conveying device) and a control circuit 61 instead of the sheet supply unit 4 and the control circuit 60 of the first embodiment.

The following description will focus on the points that differ from the first embodiment.

Figure 14:
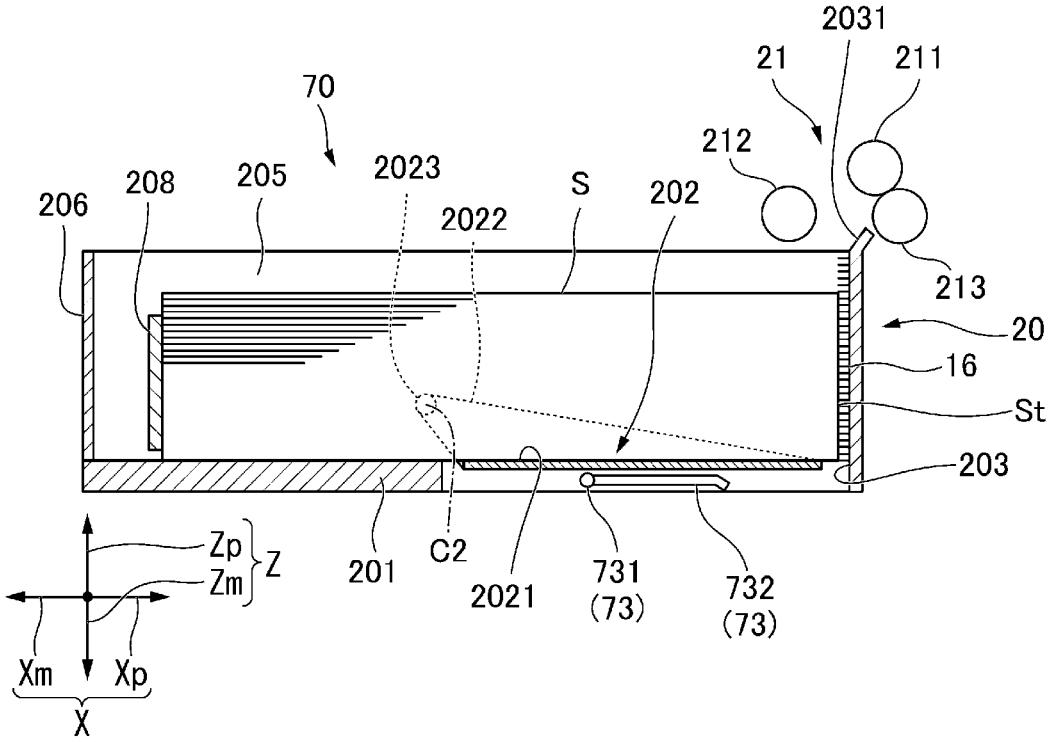
FIG. 14 is a schematic diagram of a cross section of a sheet conveying device according to a second embodiment.
Figure 15:
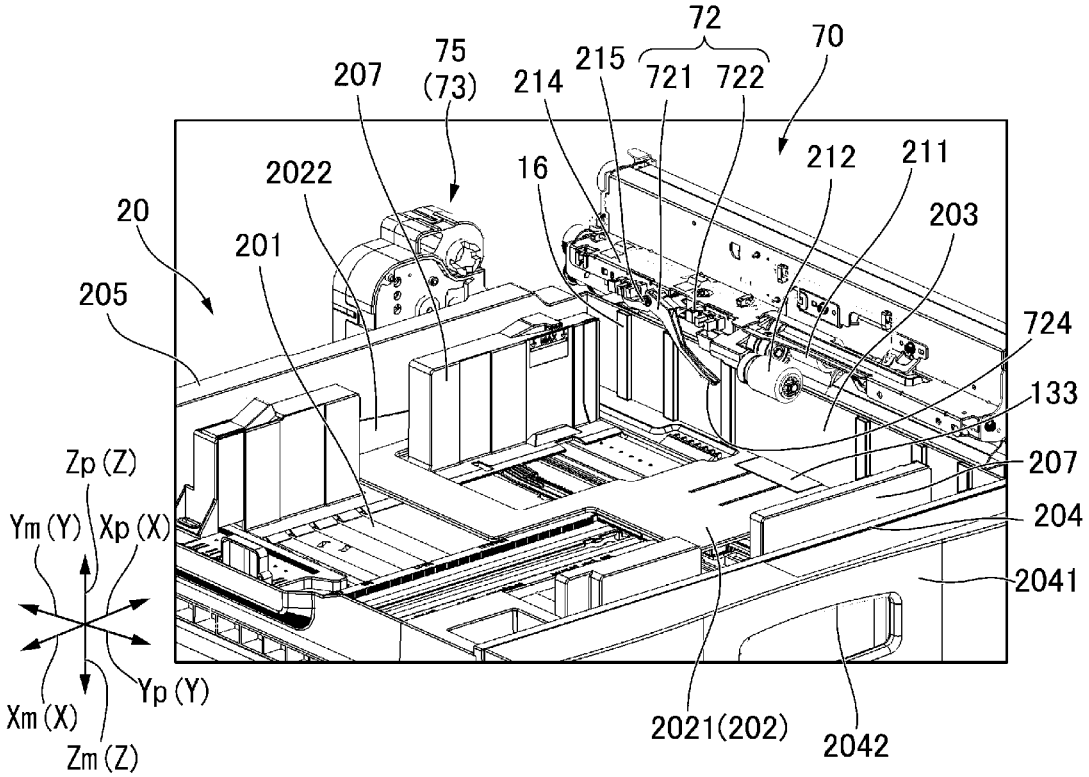
FIG. 15 is a schematic perspective view of the sheet conveying device.

FIG. 14 is a schematic diagram of a cross section of the sheet conveying device of the second embodiment. FIG. 15 is a schematic perspective view of the sheet conveying device according to the second embodiment.

As shown in FIG. 14, the sheet supply unit 70 is the same as the sheet supply unit 4 except that the resistance member 16 is added to the sheet feed cassette 20 of the sheet supply unit 4 in the first embodiment. That is, the sheet supply unit 70 includes, as in the first embodiment, the same cassette sheet feed unit 21 and sheet feed cassette 20, an elevating mechanism 73, and a tray-up detection mechanism 72 (see FIG. 15). However, the description of the elevating mechanism 73 and the tray-up detection mechanism 72 is omitted in the first embodiment. Hereinafter, the points omitted in the first embodiment will be described.

The sheet feed cassette 20 is a box type that opens in the Zp direction as a whole. In the sheet feed cassette 20, the Xp direction is the sheet S conveyance direction. Each sheet feed cassette 20 can be pulled out in the Yp direction, as in the case of the image processing apparatus 100. Unless otherwise specified, an example in which the sheet feed cassette 20 is mounted inside the image processing apparatus 101 will be described.

The sheet feed cassette 20 has a bottom surface portion 201 and a plurality of walls extending in the Zp direction from the outer edge of the bottom surface portion 201.

The bottom surface portion 201 supports the sheet S accommodated in the sheet feed cassette 20 from below.

As shown in FIGS. 14 and 15, the plurality of walls include a front end wall 203 (regulation plate), a front side wall 204 (see FIG. 15), a rear side wall 205, and a rear end wall 206 (see FIG. 14).

The front end wall 203 provided in the Xp direction is an example of a regulation plate that regulates the position of the leading end of the sheet S in the conveyance direction.

At the upper end of the front end wall 203, a conveyance guide plate 2031 that guides the conveyance of the sheet S from below extends obliquely upward toward the nip between the sheet feed roller 211 and the separation roller 213.

The resistance member 16 similar to the regulation plate 15 in the first embodiment is provided on the surface of the front end wall 203 in the Xm direction. In the present embodiment, as shown in FIG. 15, the arrangement is the same as that of the first embodiment, except that the resistance members 16 are provided at six positions separated in the Y direction. Each of the resistance members 16 linearly extends in the Z direction from the bottom surface portion 201 to the upper end of the front end wall 203.

In the Yp direction and the Ym direction, the front side wall 204 and the rear side wall 205 are provided with a space wider than the maximum width of the sheet S that can be stored in the sheet feed cassette 20.

A front cover 2041 covers the surface of the front side wall 204 in the Yp direction. In the center portion of the front cover 2041 in the X direction, a pull-out operation unit 2042 for pulling out the sheet feed cassette 20 is provided.

For example, the pull-out operation unit 2042 includes a lever that can be operated by being held by the user. When the user holds the lever of the pull-out operation unit 2042, the locked state of the sheet feed cassette 20 with respect to the device main body is released. The sheet feed cassette 20 can be pulled out in the Yp direction.

In the Xm direction, the rear end wall 206 connected to the ends of the front side wall 204 and the rear side wall 205 in the Xm direction is provided. The distance between the rear end wall 206 and the front end wall 203 in the X direction is wider than the maximum length of the sheet S that can be stored in the sheet feed cassette 20.

The sheet feed cassette 20 further includes an elevating plate 202 (tray), a side fence 207, and an end fence 208. The elevating plate 202 is an example of a tray on which a plurality of sheets are stacked.

The elevating plate 202 supports the leading end side of the sheet S placed on the bottom surface portion 201 in the conveyance direction from below.

The elevating plate 202 includes a sheet mounting plate 2021, side plates 2022, and a pivotal connection unit 2023.

The sheet mounting plate 2021 is a smooth metal plate having low sliding friction with the surface of the sheet S. As shown in FIG. 15, side fences 207 that sandwich both ends in the width direction of the sheet S penetrate through the sheet mounting plate 2021 in the thickness direction.

Similar to the elevating plate 13, a friction pad 133 is arranged at the end in the Xp direction at the center of the sheet mounting plate 2021 in the Y direction.

The side plates 2022 respectively protrude in the Zp direction from the ends of the sheet mounting plate 2021 in the Y direction. Each side plate 2022 is parallel to the ZX plane.

The pivotal connection unit 2023 rotatably connects the side plates 2022 to the front side wall 204 and the rear side wall 205.

For example, FIG. 14 shows the pivotal connection unit 2023 which is connected to the rear side wall 205. The pivotal connection unit 2023 is provided on the upper end of the side plate 2022.

The pivotal connection unit 2023 is configured by a shaft or a hole provided on the side plate 2022.

For example, when the pivotal connection unit 2023 is an axis, the pivotal connection unit 2023 extends in the Y direction from each side plate 2022 toward the rear side wall 205 and the front side wall 204. The rear side wall 205 and the front side wall 204 are formed with holes into which the pivotal connection unit 2023 is rotatably fitted.

For example, when the pivotal connection unit 2023 is a hole, protrusions extending from the rear side wall 205 and the front side wall 204 in the Y direction are provided. The pivotal connection unit 2023 is rotatably fitted to the protrusion.

Each pivotal connection unit 2023 is formed coaxially with the axis C2 extending in the Y direction.

The elevating plate 202 is connected to the rear side wall 205 and the front side wall 204 via the pivotal connection unit 2023 to be rotatable around the axis C2.

The end fence 208 regulates the position of the sheet S placed in the sheet feed cassette 20 in the Xm direction. The end fence 208 is fixed on the bottom surface portion 201 to be able to be relocated depending on the length of the sheet S.

Figure 16:
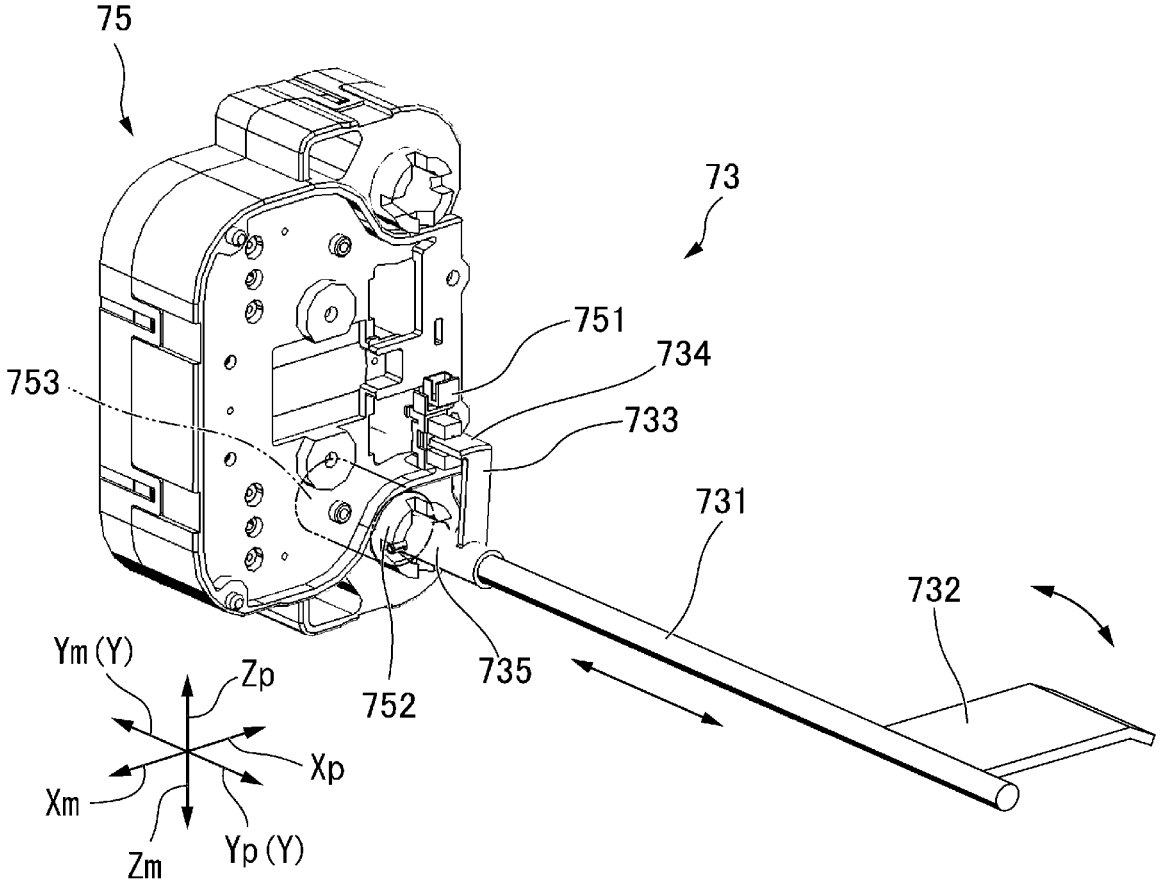
FIG. 16 is a schematic perspective view of an elevating mechanism in an image processing apparatus according to the second embodiment.
Figure 17:
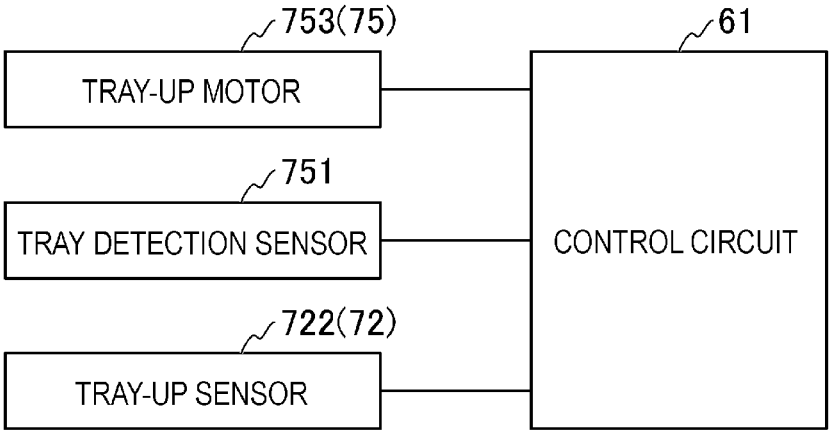
FIG. 17 is a block diagram of a control system.
Figure 18:
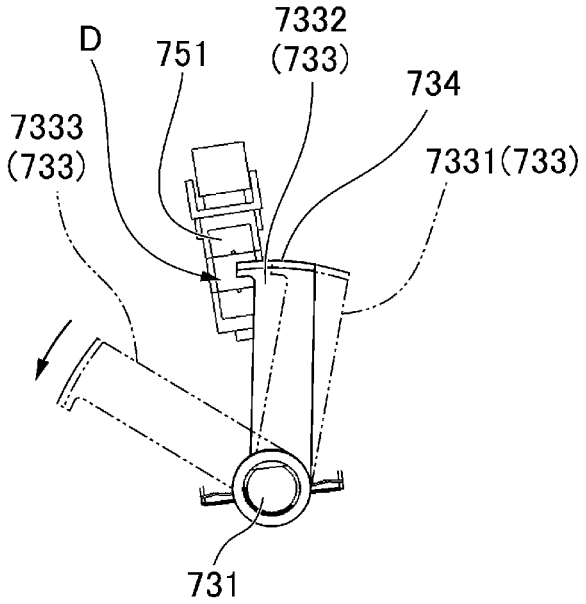
FIG. 18 is an operation explanatory diagram of a tray detection sensor.

FIG. 16 is a schematic perspective view of an elevating mechanism in the image processing apparatus of the second embodiment. FIG. 17 is a block diagram of a control system in the image processing apparatus of the second embodiment. FIG. 18 is an operation explanatory diagram of the tray detection sensor in the image processing apparatus of the second embodiment.

As shown in FIG. 16, the elevating mechanism 73 includes a tray-up shaft 731, a pressing plate 732, a connection unit 735, an actuator 733, a light blocking plate 734, and a drive unit 75.

The tray-up shaft 731 is a shaft member extending in the Y direction. As shown in FIG. 14, the tray-up shaft 731 is arranged below the sheet mounting plate 2021. The tray-up shaft 731 extends from the position of the sheet feed cassette 20 protruding from the rear side wall 205 in the Ym direction to the center portion of the sheet feed cassette 20 in the Y direction.

The tray-up shaft 731 is supported by the sheet feed cassette 20 to be rotatable about the central axis thereof.

As shown in FIG. 16, the pressing plate 732 is provided at the end of the tray-up shaft 731 in the Yp direction, and the connection unit 735 is provided at the end in the Ym direction.

The pressing plate 732 is fixed to the end of the tray-up shaft 731 in the Yp direction. The pressing plate 732 extends in the radial direction of the tray-up shaft 731.

As shown in FIG. 14, when the upper surface of the sheet mounting plate 2021 is flush with the upper surface of the bottom surface portion 201, the pressing plate 732 is arranged between the sheet mounting plate 2021 and the bottom surface of the sheet feed cassette 20.

When the tray-up shaft 731 is rotated counterclockwise when viewed from the Ym direction, the pressing plate 732 rotates together with the tray-up shaft 731 and gradually stands up toward the sheet mounting plate 2021.

As shown in FIG. 16, the connection unit 735 is fixed to the end of the tray-up shaft 731 in the Ym direction. The connection unit 735 is detachably connected to a coupling 752 of the drive unit 75 described later in the Y direction. The connection unit 735 engages with the coupling 752 around the central axis of the tray-up shaft 731.

The engagement structure between the connection unit 735 and the coupling 752 is not particularly limited. For example, if the coupling 752 has a cylindrical shape in which an engaging groove that opens in the Yp direction is provided in the circumferential direction, the connection unit 735 may include an engaging shaft that can be inserted into the engaging groove from the Ym direction and protrudes radially outward.

The actuator 733 is a protruding piece that extends from the outer peripheral portion of the connection unit 735 to the radial outside of the tray-up shaft 731.

The protruding direction of the actuator 733 is approximately 90 degrees counterclockwise with respect to the pressing plate 732 when viewed from the Ym direction. When the pressing plate 732 extends substantially horizontally in the ZX plane, the actuator 733 protrudes vertically upward.

The light blocking plate 734 protrudes in the Ym direction from the distal end portion of the actuator 733 in the protruding direction.

As shown in FIG. 15, the drive unit 75 is fixed to the device main body of the sheet supply unit 70 in the Ym direction from the rear side wall 205 of the sheet feed cassette 20.

As shown in FIG. 16, the drive unit 75 includes the coupling 752, a tray-up motor 753, and a tray detection sensor 751.

The coupling 752 can be attached to and detached from the connection unit 735 in the Y direction and can be engaged with the connection unit 735 in the circumferential direction of the tray-up shaft 731 when connecting to the connection unit 735.

The tray-up motor 753 includes a motor shaft extending in the Y direction. The coupling 752 is fixed to the end of the motor shaft in the Yp direction.

As shown in FIG. 17, the tray-up motor 753 is communicatively connected to the control circuit 61 described later. The rotation amount and rotation direction of the motor shaft of the tray-up motor 753 are controlled according to the control signal transmitted from the control circuit 61.

The tray detection sensor 751 is electrically connected to the control circuit 61 described later. The tray detection sensor 751 detects whether the sheet mounting plate 2021 started to ascend, and transmits a detection signal to the control circuit 61 when the sheet mounting plate 2021 starts to ascend.

In the present embodiment, the tray detection sensor 751 is configured of a photo interrupter. The tray detection sensor 751 is arranged on the moving path of the light blocking plate 734 on the surface of the drive unit 75 in the Yp direction.

As shown in FIG. 18, the tray detection sensor 751 includes a light emitting unit and a light receiving unit for the detection light, and a detection area D for emitting the detection light is formed between the light emitting unit and the light receiving unit.

When the pressing plate 732 is not pressing the sheet mounting plate 2021, the actuator 733 is at the position of the actuator 7331 shown by the chain double-dashed line. Here, the light blocking plate 734 of the actuator 7331 is located outside the detection area D.

When the pressing plate 732 starts pressing the sheet mounting plate 2021, the actuator 733 is rotating to the position of the actuator 7332 shown by the solid line. Here, the light blocking plate 734 of the actuator 7332 blocks the detection light in the detection area D. The tray detection sensor 751 transmits a detection signal to the control circuit 61 when the control circuit 61 detects that the sheet mounting plate 2021 started to ascend.

As will be described later, the detection signal of the tray detection sensor 751 is used to control the amount of elevation of the sheet mounting plate 2021 in the elevation mechanism 73.

As shown in FIG. 15, the tray-up detection mechanism 72 includes an actuator 721 and a tray-up sensor 722.

The tray-up detection mechanism 72 is fixed to the side surface in the Xm direction of a stay 213 extending in the Y direction in the cassette sheet feed unit 21 of the printer unit 3.

The tray-up detection mechanism 72 detects that the leading end of the sheet S placed on the sheet feed cassette 20 in the conveyance direction ascended to a position to be in contact with the pickup roller 212.

The actuator 721 is a lever rotatably supported by a rotation support shaft 215 extending from the stay 215 in the Xm direction. The actuator 721 is rotatable in the YZ plane.

The actuator 721 includes a detection unit 724 that abuts on the uppermost surface of the sheets S in the sheet feed cassette 20 and detects the position of the uppermost surface. When the detection unit 724 is not in contact with the sheet S, the actuator 721 is inclined downward due to its own weight. When the detection unit 724 is pushed up to the maximum by the sheets S, the actuator 721 becomes substantially horizontal.

The detection unit 724 is pushed up to the maximum when the uppermost surface of the sheets S stored in the sheet feed cassette 20 is lifted to a position to be in contact with the pickup roller 212 from below.

When the sheet mounting plate 2021 is lifted without the sheet S being placed on the sheet mounting plate 2021, the detection unit 724 is depressed in the hole formed in the sheet mounting plate 2021. Here, the detection unit 724 is not pushed up to the maximum.

The tray-up sensor 722 detects that the detection unit 724 was pushed up to the maximum. For example, a photo interrupter is used as the tray-up sensor 722.

As shown in FIG. 17, the tray-up sensor 722 is communicatively connected to a control circuit 61 described later. When the tray-up sensor 722 detects that the detection unit 724 was pushed up to the maximum, the tray-up sensor 722 transmits a detection signal to the control circuit 61.

The control circuit 61 is the same as the control circuit 60 in the first embodiment, except that the sheet supply unit 70 performs the separating operation of the sheets S placed on the sheet feed cassette 20.

As shown in FIG. 17, the control circuit 61 is electrically connected to the tray-up motor 753, the tray detection sensor 751, and the tray-up sensor 722.

For example, the control circuit 61 transmits a control signal to the drive unit 75 in the elevating mechanism 73 to control the elevation of the sheet mounting plate 2021. The control circuit 61 lifts and lowers the sheet mounting plate 2021 to separate the plurality of sheets S placed on the sheet feed cassette 20.

Next, the operation of the sheet supply unit 70 in the image processing apparatus 101 will be described focusing on the separating operation of the sheet feed cassette 20. Descriptions of operations common to the first embodiment may be omitted.

Figure 19:
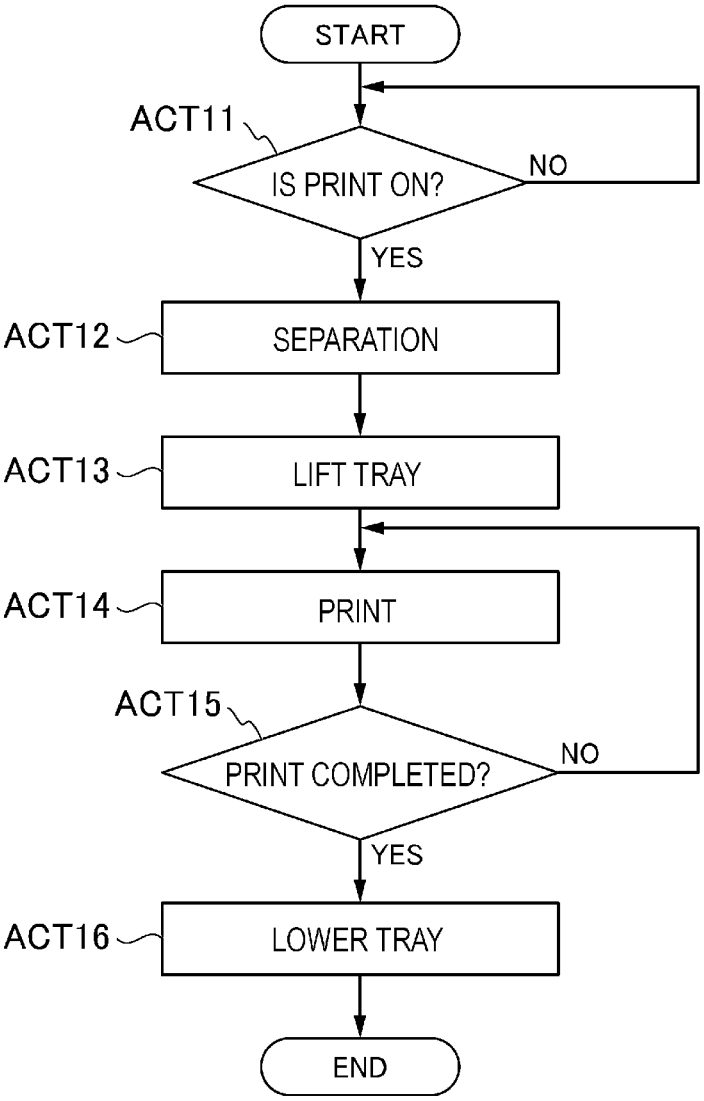
FIG. 19 is a flowchart of an image forming operation by cassette sheet feeding.
Figure 20A:
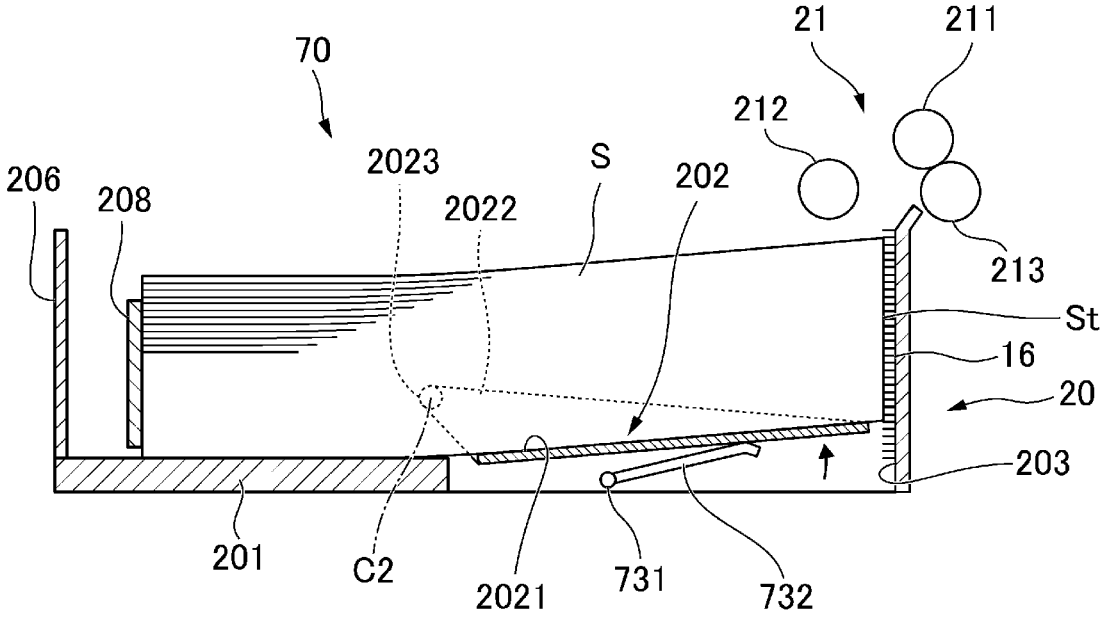
FIG. 20A is an operation explanatory diagram of the sheet conveying device.
Figure 20B:
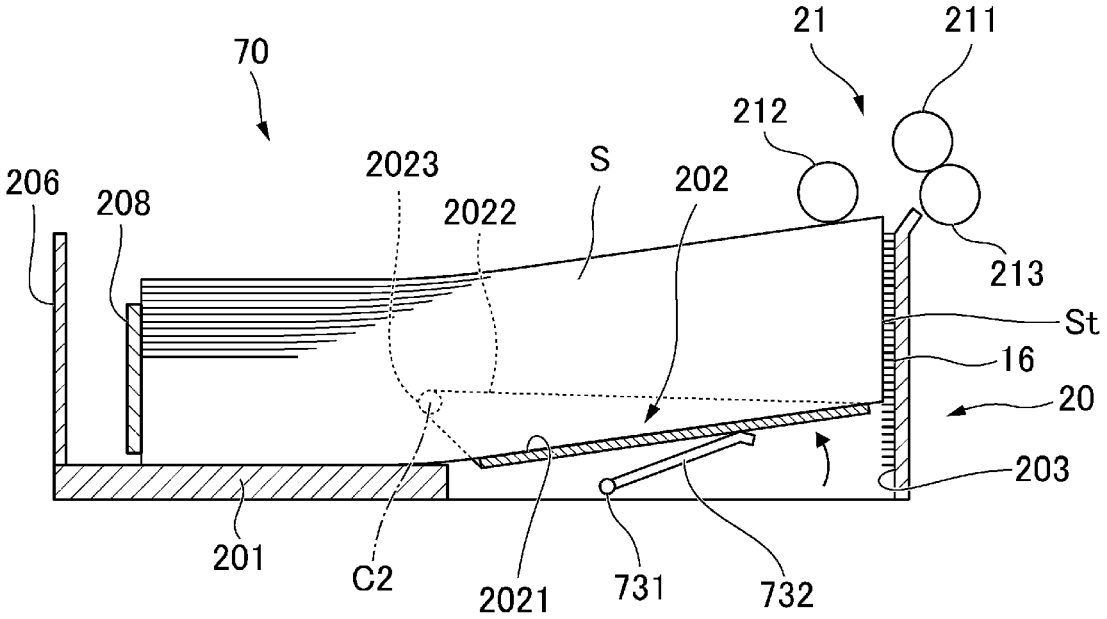
FIG. 20B is an operation explanatory diagram of the sheet conveying device.

FIG. 19 is a flowchart of an image forming operation by cassette sheet feeding in the image processing apparatus of the second embodiment. FIGS. 20A and 20B are operation explanatory diagrams of the sheet conveying device of the second embodiment.

In the image processing apparatus 101, when an image is formed using the sheet S in the sheet feed cassette 20, the control circuit 61 performs the control to execute ACT 11 to ACT 16 shown in FIG. 19.

In the following, an example in which a plurality of sheets S are placed in the sheet feed cassette 20 in advance will be described. As shown in FIG. 14, the pressing plate 732 extends substantially horizontally, and the elevating plate 202 is not pressed by the pressing plate 732. Here, the upper surface of the sheet mounting plate 2021 is flush with the upper surface of the bottom surface portion 201. Such a position of the sheet mounting plate 2021 is the lowermost position in the sheet feed cassette 20. The arrangement of the elevating plate 202 in which the sheet mounting plate 2021 is lowered to the lowermost position is referred to as a first lowered position.

The uppermost surface of the sheets S is separated below the pickup roller 212.

The leading end St of each sheet S in the conveyance direction is in contact with the resistance member 16.

In ACT 11, it is determined whether the control circuit 61 received the print start signal.

When the print start signal is received (ACT 11: YES), the control circuit 61 executes ACT 12.

When the print start signal is not received (ACT 11: NO), the control circuit 61 repeats ACT 11.

In ACT 12, the control circuit 61 transmits a control signal to the elevating mechanism 73 to execute the separation as follows.

The control circuit 61 transmits a control signal to the elevating mechanism 73 to perform at least one elevating operation. In one elevating operation, the elevating mechanism. 73 lifts the sheet mounting plate 2021 from the first lowered position to a predetermined lifted position (see FIG. 20A) and lowers the sheet mounting plate 2021 from the lifted position to the first lowered position (see FIG. 14), and transmits a control signal for performing the elevating operation.

As shown in FIG. 20A, the elevating mechanism 73 that received the control signal drives the tray-up motor 753 to rotate the tray-up shaft 731 counterclockwise when viewed from the Ym direction.

As shown in FIG. 18, when the actuator 733 rotates to the position of the actuator 7332, the tray detection sensor 751 transmits a detection signal to the control circuit 61.

The control circuit 61 further rotates the tray-up shaft 731 counterclockwise until the predetermined ascending time elapses from the time when the detection signal is received. Along with the tray-up shaft 731, the pressing plate 732 also rotates counterclockwise. The elevating plate 202 pressed from below by the pressing plate 732 rotates counterclockwise about the axis C2.

The ascending time is the time required for the elevating plate 202 to reach the lifted position in the separating operation. As shown in FIG. 20A, the predetermined lifted position in the separating operation is at a height at which the uppermost sheet S does not come into contact with the pickup roller 212 even if the maximum allowable stacking number of sheets S are placed.

The leading end St of the sheet S slides on the resistance member 16 while the elevating plate 202 is ascending. Here, the resistance member 16 has the same action as when the elevating plate 13 in the first embodiment ascends. As a result, the leading ends St of the plurality of sheets S in contact with the resistance member 16 are separated from the upper side to the lower side while the elevating plate 202 is ascending. In the plurality of separated sheets S, since air enters between the sheets in the vicinity of the leading end St, the adhesion force between the sheets S that are in close contact with each other is reduced in the vicinity of the leading ends St.

When the ascending time passed, the control circuit 61 switches the rotation direction of the tray-up motor 753 to lower the elevating plate 202.

As shown in FIG. 20B, while the elevating plate 202 descends toward the first lowered position, the leading end St of the sheet S slides on the resistance member 16 and is rolled up. Here, the resistance member 16 has the same action as when the elevating plate 13 in the first embodiment descends. As a result, the leading ends St of the plurality of sheets S in contact with the resistance member 16 are separated from the lower side to the upper side while the elevating plate 202 is descending. In the plurality of separated sheets S, since air enters between the sheets in the vicinity of the leading end St, the adhesion force between the sheets S that are in close contact with each other is reduced in the vicinity of the leading end St.

In particular, when the elevating plate 13 is lowered, the sheets S are repeatedly rolled up by sliding on the resistance member 16 and then dropped downward by gravity. Therefore, the plurality of sheets S are more strongly separated when descending, together with the fact that the plurality of sheets S are separated to some extent when ascending.

When the elevating operation of the elevating plate 202 is performed a predetermined number of times, ACT 12 ends. After that, the control circuit 61 executes ACT 13.

In ACT 13, the control circuit 61 transmits a control signal to the elevating mechanism 73 to move the elevating plate 202 from the first lowered position to the uppermost position.

The control circuit 61 lifts the elevating plate 202 by the elevating mechanism 73, similarly to ACT 12.

As the elevating plate 202 ascends, the uppermost surface of the sheets S pushes up the detection unit 724 of the actuator 721. When the elevating plate 202 reaches the uppermost position, the tray-up sensor 722 detects the actuator 721 pushed up to the uppermost surface of the sheets S and transmits a detection signal to the control circuit 61.

Upon receiving the detection signal from the tray-up sensor 722, the control circuit 61 transmits a control signal for stopping the tray-up motor 753 to the drive unit 75.

As such, the elevating plate 202 ascends to the uppermost position where the uppermost surface of the plurality of sheets S is in contact with the pickup roller 112.

Thus, ACT 13 is completed. After that, the control circuit 61 executes ACT 14.

However, when the sheet S is not placed on the elevating plate 202, a detection signal is not transmitted from the tray-up sensor 722 to the control circuit 61 even if the time for the elevating plate 202 to ascend to the uppermost position elapses. Here, the control circuit 61 determines that the sheet S is not placed.

Here, the control circuit 61 may display on the control panel 1 that the sheet S is not placed in the sheet cassette 20 after the elevating plate 202 is lowered to the first lowered position. The user pulls out the sheet feed cassette 20, replenishes the sheets S, and pushes the sheet feed cassette 20 into the sheet supply unit 70. When the control circuit 61 detects that the sheet feed cassette 20 is mounted, the control circuit 61 executes ACT 12.

However, the control circuit 61 may display on the control panel 1 that the sheet S is not placed in the sheet cassette 20 while the elevating plate 202 is kept at the uppermost position. Here, when the user pulls the sheet feed cassette 20, the engagement between the coupling 752 and the connection unit 735 is released, and thus the elevating plate 202 descends to the first lowered position by its own weight. The user can pull out the sheet feed cassette 20. After that, the user replenishes the sheets S and pushes the sheet feed cassette 20 into the sheet supply unit 70, as described above. When the control circuit 61 detects that the sheet feed cassette 20 is mounted, the control circuit 61 executes ACT 12.

ACTS 14 and 15 are the same as ACTS 7 and 8 in the first embodiment, except that one sheet S is conveyed from the sheet feed cassette 20 to the conveyance unit 5.

In ACT 16, the control circuit 61 transmits a control signal to the elevating mechanism 73 to lower the elevating plate 202 from the uppermost position to the first lowered position.

Thus, the image forming operation when the sheet S is fed from the sheet feed cassette 20 is completed.

According to the image processing apparatus 101 of the present embodiment, since the sheet feed cassette 20 includes the resistance member 16 and the control circuit 61 that lifts and lowers the elevating plate 202 to perform the separation, it is possible to prevent double feeding in the sheet supply unit 70 even if the user does not separate the sheets S before placing the sheets S.

Third Embodiment

A sheet conveying device and an image processing apparatus according to a third embodiment will be described.

As shown in FIG. 1, an image processing apparatus 102 of the present embodiment includes a sheet supply unit 80 (sheet conveying device) and a control circuit 62 instead of the sheet supply unit 70 and the control circuit 61 of the second embodiment.

The following description focuses on the points that differ from the second embodiment.

Figure 21:
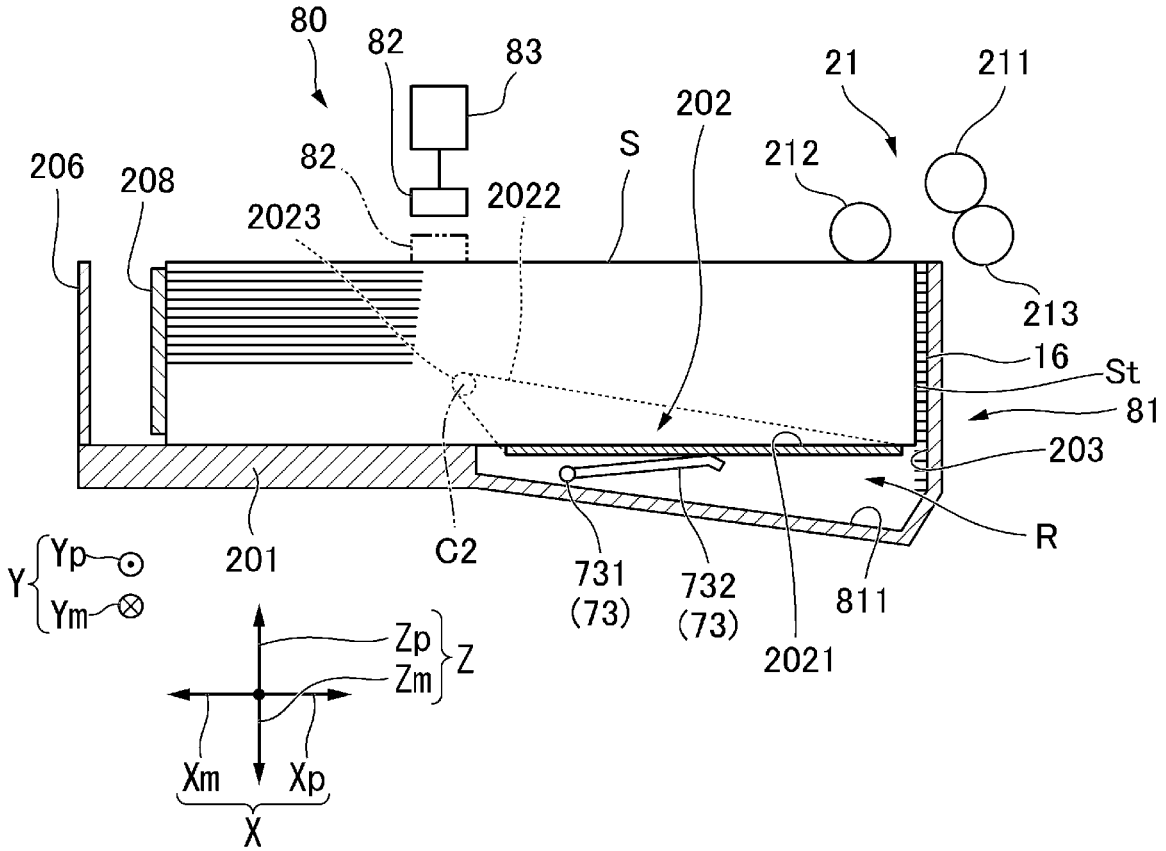
FIG. 21 is a schematic diagram of a cross section of a sheet conveying device (first lowered position) according to a third embodiment.
Figure 22:
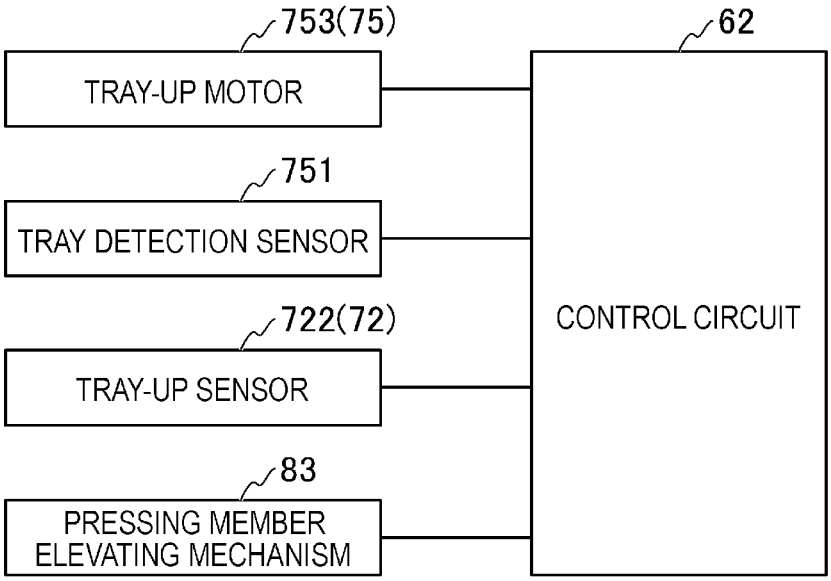
FIG. 22 is a block diagram of a control system in an image processing apparatus of the third embodiment.
Figure 23:
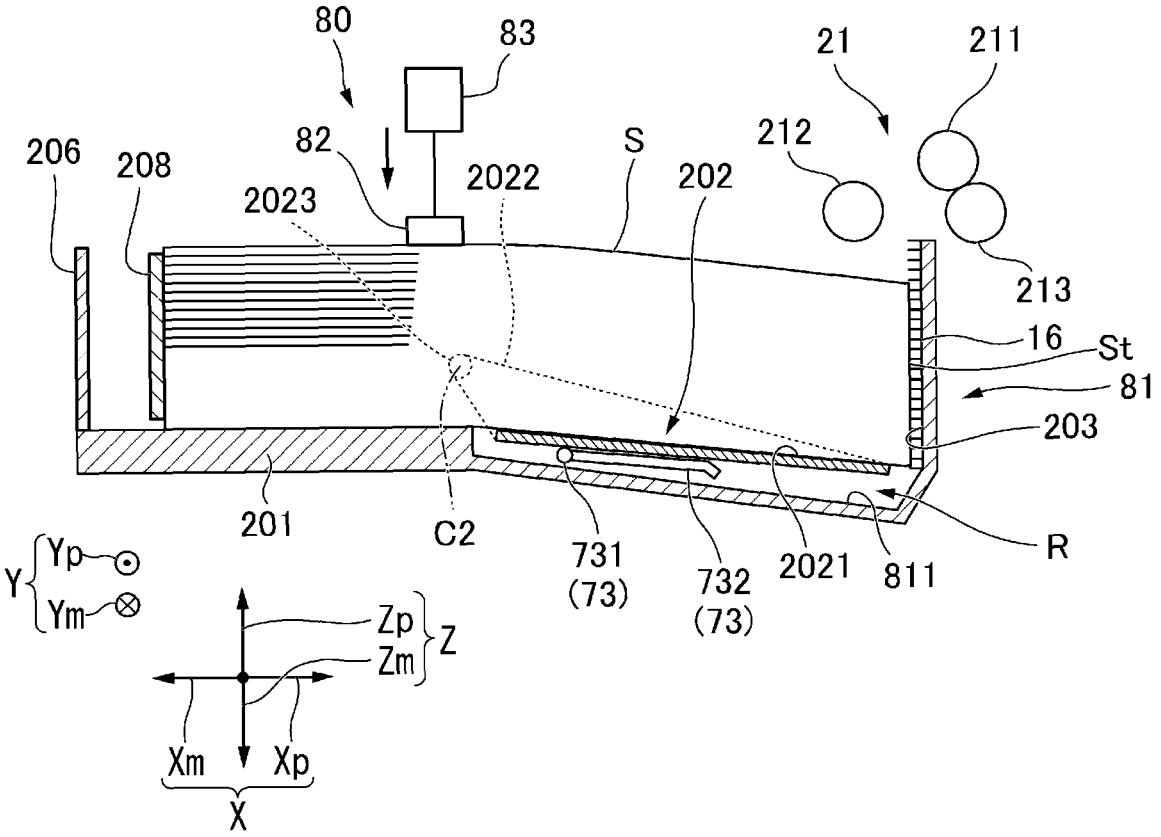
FIG. 23 is a schematic diagram of a cross section of the sheet conveying device (second lowered position) of the third embodiment.

FIG. 21 is a schematic diagram of a cross section of the sheet conveying device (first lowered position) of the third embodiment. FIG. 22 is a block diagram of a control system in the image processing apparatus of the third embodiment. FIG. 23 is a schematic diagram of a cross section of the sheet conveying device (second lowered position) of the third embodiment.

As shown in FIG. 21, the sheet supply unit 80 includes a sheet feed cassette 81 instead of the sheet feed cassette 20 of the sheet supply unit 70 in the second embodiment. The sheet supply unit 80 further includes a pressing member 82 and a pressing member elevating mechanism 83.

The sheet feed cassette 81 differs from the sheet feed cassette 20 in the second embodiment in that an inclined bottom surface portion 811 is provided below the sheet mounting plate 2021. In the example shown in FIG. 21, the conveyance guide plate 2031 in the sheet feed cassette 20 is deleted. However, the conveyance guide plate 2031 may also be provided on the front end wall 203 of the sheet feed cassette 81.

The inclined bottom surface portion 811 is inclined in the Zm direction from the end of the bottom surface portion 201 close to the end of the sheet mounting plate 2021 in the first lowered position in the Xm direction as advancing in the Xp direction.

A lower space R in which the sheet mounting plate 2021 can rotate is formed between the sheet mounting plate 2021 and the inclined bottom surface portion 811 in the first lowered position.

The pressing member 82 presses the sheet S above the bottom surface portion 201 from above. The pressing member 82 is arranged above the end of the bottom surface portion 201 in the Xp direction.

The pressing member 82 is arranged in a range in which the uppermost surface of the sheets S having the smallest width that can be set in the sheet feed cassette 81 can be pressed in the Y direction.

The pressing member 82 is supported by a pressing member elevating mechanism 83 fixed to the device main body of the sheet supply unit 80 to be able to be lifted and lowered in the Z direction.

The pressing member elevating mechanism 83 includes, for example, a driving member such as a motor or a solenoid. As shown in FIG. 22, the pressing member elevating mechanism 83 is communicatively connected to the control circuit 62. The pressing member elevating mechanism 83 lifts and lowers the pressing member 82 based on the control signal transmitted from the control circuit 62.

According to the present embodiment, as shown in FIG. 23, when viewed from the Ym direction, the sheet mounting plate 2021 is rotated clockwise about the axis C2, so that the sheet mounting plate 2021 can be lowered inside the lower space R lower than the upper surface of the bottom surface portion 201. As shown in FIG. 23, the position of the elevating plate 202 where the sheet mounting plate 2021 is lowered to the lowermost side is referred to as a second lowered position.

When the sheet S is placed on the sheet mounting plate 2021 and the sheet mounting plate 2021 is rotated below the first lowered position, the sheet S can be bent at the end of the sheet mounting plate 2021 in the Xm direction.

The pressing member 82 can press the sheet S at a position close to the bent portion of the sheet S.

The lower end of the front end wall 203 in the present embodiment is connected to the end of the inclined bottom surface portion 811 in the Xp direction. The resistance member 16 provided on the front end wall 203 in the present embodiment extends to a position that is equal to or lower than the height of the end in the Xp direction of the sheet mounting plate 2021 in the second lowered position. Therefore, the resistance member 16 can come into contact with the leading end St of the sheet S placed on the sheet mounting plate 2021 in the second lowered position.

As shown in FIG. 22, the control circuit 62 is electrically connected to the tray-up motor 753, the tray detection sensor 751, the tray-up sensor 722, and the pressing member elevating mechanism 83.

The control circuit 62 is similar to that of the second embodiment, except that the control circuit 62 can control the elevating mechanism 73 to lift and lower the elevating plate 202 between the second lowered position and the uppermost position.

Next, the operation of the sheet supply unit 80 in the image processing apparatus 102 will be described focusing on the separating operation of the sheet feed cassette 81. Descriptions of operations common to the second embodiment may be omitted.

Figure 24:
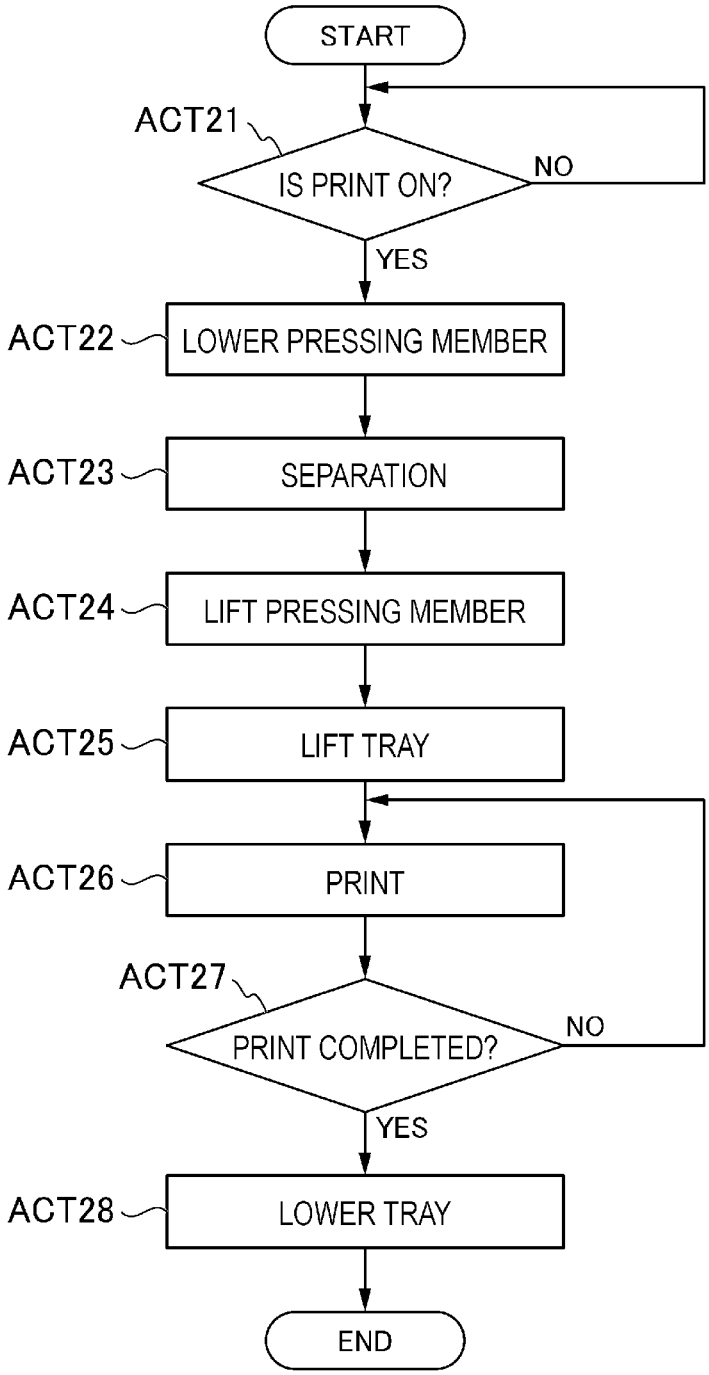
FIG. 24 is a flowchart of an image forming operation by cassette sheet feeding.

FIG. 24 is a flowchart of an image forming operation by cassette sheet feeding in the image processing apparatus of the third embodiment.

In the image processing apparatus 102, when an image is formed using the sheet S in the sheet feed cassette 81, the control circuit 62 performs the control to execute ACT 21 to ACT 28 shown in FIG. 24.

In the following, an example in which a plurality of sheets S are placed in the sheet feed cassette 81 in advance will be described. As shown in FIG. 21, the pressing plate 732 supports the sheet mounting plate 2021 from below so that the sheet mounting plate 2021 is flush with the upper surface of the bottom surface portion 201. Such a position of the sheet mounting plate 2021 is the first lowered position in this embodiment.

The pressing member 82 is separated upward from the uppermost surface of the sheets S.

The leading end St of each sheet S in the conveyance direction is in contact with the resistance member 16.

In ACT 21, the control circuit 62 determines whether the print start signal is received.

When the print start signal is received (ACT 21: YES), the control circuit 62 executes ACT 22.

When the print start signal is not received (ACT 21: NO), the control circuit 62 repeats ACT 21.

In ACT 22, the control circuit 62 transmits a control signal to lower the pressing member 82 to the position to press the uppermost surface of the sheets S to the pressing member elevating mechanism 83.

As shown in the dash-dotted line in FIG. 21, the pressing member 82 presses the uppermost surface of the sheets S toward the bottom surface portion 201.

After ACT 22, ACT 23 is executed.

In ACT 23, the control circuit 62 transmits a control signal to the elevating mechanism 73 to execute the separation as follows.

The control circuit 62 transmits a control signal to the elevating mechanism 73 to perform at least one elevating operation.

In one elevating operation, the elevating mechanism 73 lifts the sheet mounting plate 2021 from the first lowered position to a predetermined lifted position.

In the present embodiment, the predetermined lifted position is the uppermost position where the uppermost surface of the sheets S contacts the pickup roller 212, or the lifted position near the uppermost position.

In the example shown in FIG. 21, the maximum allowable number of sheets S are placed, and the uppermost surface of the sheets S is in contact with the pickup roller 212 when the sheet feed cassette 81 is mounted to the sheet supply unit 80. Here, the elevating mechanism 73 does not lift the elevating plate 202.

After the elevating plate 202 reaches the predetermined lifted position, the elevating mechanism 73 of the present embodiment lowers the elevating plate 202 to the second lowered position.

In the present embodiment, when the above-described elevating operation is performed, the leading ends St of the sheets S are separated as in the second embodiment, except that the elevating range is different.

In the present embodiment, the ascending operation may not be performed depending on the stacking amount of the sheets S. However, as described in the second embodiment, the degree to which the sheet S is separated is stronger when the sheet S is lowered than when the sheet S is lifted. Therefore, in the present embodiment as well, the same action as that of the second embodiment can be obtained by the separation.

In the present embodiment, the sheet S is pressed from above by the pressing member 82 toward the bottom surface portion 201 during the separation. Therefore, it is possible to prevent the sheet S from slipping and pressing the resistance member 16 too much when the sheet S descends. As a result, it is possible to prevent the sliding resistance between the resistance member 16 and the leading end St of the sheet S from increasing excessively when ascending.

If the sliding resistance between the resistance member 16 and the leading end St becomes too large, the size of the tray-up motor 753 may become large, or the leading end St of the sheet S may be damaged during sliding. In the present embodiment, such a possibility can be prevented.

However, when the stacking capacity of the sheet feed cassette 81 is not so large, the sliding resistance may not be excessive even if the sheet S is not pressed by the pressing member 82. Here, the pressing member 82 and the pressing member elevating mechanism 83 may be omitted.

In the case of omitting the pressing member 82 and the pressing member elevating mechanism 83, since the stack of the stacked sheets S is bent downward due to its own weight when the elevating plate 202 descends, shear slip occurs between the sheets S. When shear slip occurs, the adhesion between the sheets S is relaxed, and the separating effect is increased.

When the elevating operation of the elevating plate 202 is performed a predetermined number of times, ACT 23 ends. After that, the control circuit 61 executes ACT 24.

In ACT 24, the control circuit 62 transmits a control signal to the pressing member elevating mechanism 83 to lift the pressing member 82 from the uppermost surface of the sheets S to a position where the pressing member 82 is separated upward.

As a result, since the pressing of the pressing member 82 is released, the sheet S can be moved in the conveyance direction.

After ACT 24, ACT 25 is executed.

ACT 25 to ACT 28 are the same as ACT 14 to ACT 16 in the second embodiment, except that they are executed based on the control signal from the control circuit 62.

Thus, the image forming operation when the sheet S is fed from the sheet feed cassette 81 is completed.

According to the image processing apparatus 102 of the present embodiment, since the sheet feed cassette 81 includes the resistance member 16 and the control circuit 62 that lifts and lowers the elevating plate 202 to perform the separation, it is possible to prevent double feeding in the sheet supply unit 70 even if the user does not separate the sheets S before placing the sheets S.

Hereinafter, modifications of the above-described embodiments will be described.

Figure 25A:
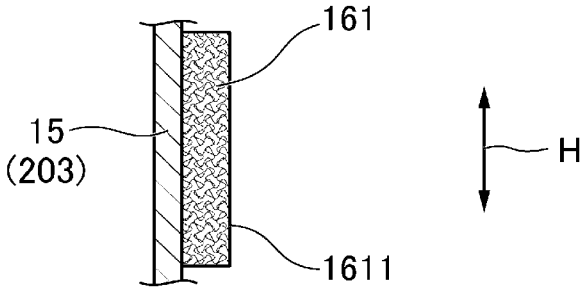
FIG. 25A is a schematic diagram of a cross section showing a modification (first modification) of a resistance member in the sheet conveying device of each embodiment.

FIG. 25A is a schematic diagram of a cross section showing a modification (first modification) of the resistance member in the sheet conveying device of each embodiment.

As shown in FIG. 25A, a resistance member 161 may be used instead of the resistance member 16 of each embodiment.

The resistance member 161 has a flat surface 1611 macroscopically but is made of a material that has a large sliding resistance with the leading end St of the sheet S.

For example, in the resistance member 161, the surface layer portion that contacts the sheet S is formed of felt cloth. The surface 1611 of the resistance member 161 is a flat surface as a whole along the stacking direction H, but when viewed microscopically, the surface 1611 is formed of a finely uneven surface in which fibers are randomly entangled.

Therefore, as compared with a smooth surface such as resin or metal, the coefficient of friction with respect to the sheet S is large, and thus the sliding resistance with the leading end St of the sheet S is large.

If the sliding resistance becomes large, when the leading ends St of the sheets S move in the stacking direction H, the leading ends of the sheets S cause stick-slip, and are thus separated.

As a material that can increase the sliding resistance with the leading end St of the sheet S even though the resistance member 161 has a macroscopically flat surface 1611, other than felt, for example, an elastomer, a foamed elastomer, cork, a non-woven fabric, or the like can be used.

Figure 25B:
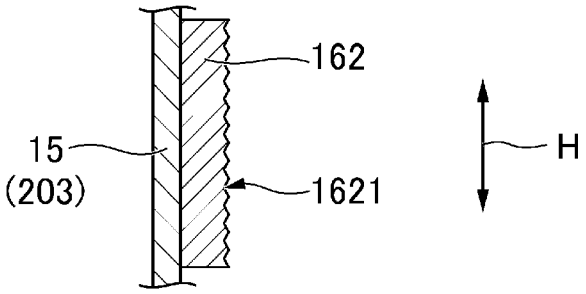
FIG. 25B is a schematic diagram of a cross section showing a modification (second modification) of the resistance member in the sheet conveying device of each embodiment.

FIG. 25B is a schematic diagram of a cross section showing a modification (second modification) of the resistance member in the sheet conveying device of each embodiment.

As shown in FIG. 25B, a resistance member 162 may be used instead of the resistance member 16 of each embodiment. The surface 1621 of the resistance member 162 that contacts the sheet S has an uneven structure.

The resistance member 162 can be made of, for example, a synthetic resin or an elastomer having an uneven structure on the surface 1621. Examples of the uneven structure include a corrugated shape in which unevenness changes in the stacking direction H, and a mountain-shaped uneven shape.

If the uneven structure is formed on the surface 1621, when each leading end St of the sheet S moves along the stacking direction H, the leading end St vibrates when passing over the uneven structure, and is thus separated.

Figure 25C:
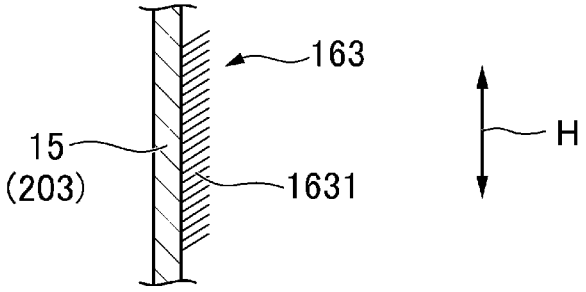
FIG. 25C is a schematic diagram of a cross section showing a modification (third modification) of the resistance member in the sheet conveying device of each embodiment.

FIG. 25C is a schematic diagram of a cross section showing a modification (third modification) of the resistance member in the sheet conveying device of each embodiment.

As shown in FIG. 25C, a resistance member 163 may be used instead of the resistance member 16 of each embodiment. Similar to the resistance member 16, the resistance member 163 includes a napped material. However, the fibers 1631 in the napped material of the resistance member 163 are inclined obliquely upward with respect to the stacking direction H.

Therefore, the sliding resistance of the resistance member 163 with respect to the sheet S is higher when the sheet S is lowered than when the sheet S is lifted. As a result, the sheet S is separated particularly efficiently when descending.

Figure 25D:
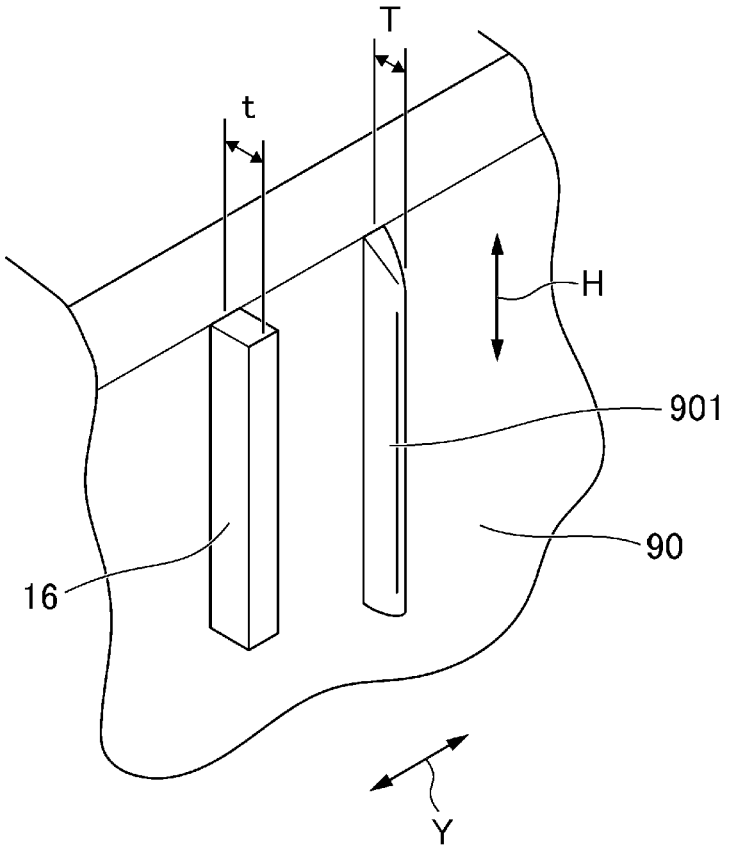
FIG. 25D is a schematic diagram of a cross section showing a modification (fourth modification) of a regulation plate in the sheet conveying device of each embodiment.

FIG. 25D is a schematic diagram of a cross section showing a modification (fourth modification) of the regulation plate in the sheet conveying device of each embodiment.

As shown in FIG. 25D, a regulation plate 90 may be used instead of the regulation plate 15 or the front end wall 203 of each embodiment. The regulation plate 90 has a protrusion 901 formed on the surface provided with the resistance member 16 to be separated from the resistance member 16 in the Y direction. A plurality of protrusions 901 are provided in a range in which the protrusions 901 can contact the leading end St of the sheet S that can be placed on the sheet conveying device.

The height T of the protrusion 901 is lower than the height t of the resistance member 16. The protrusion 901 has a rounded end at the distal end in the protruding direction to reduce sliding resistance with the sheet S.

Since the regulation plate 90 of this modification includes a plurality of protrusions 901, the leading end St of the sheet S abuts the plurality of protrusions 901 when the sheet S is placed. Since the sheets S are guided by the protrusions 901 when the sheets S are separated, the position of the leading ends St of the sheets S are less likely to vary.

According to the modification, since the leading end St of the sheet S abuts each of the protrusions 901, the length by which the resistance member 16 enters the sheet S is restricted to (t-T), and thus, the sliding resistance is stabilized.

Figure 25E:
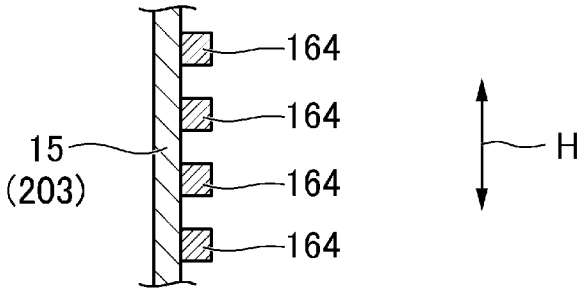
FIG. 25E is a schematic diagram of a cross section showing a modification (fifth modification) of the resistance member in the sheet conveying device of each embodiment.

FIG. 25E is a schematic diagram of a cross section showing a modification (fifth modification) of the resistance member in the sheet conveying device of each embodiment.

As shown in FIG. 25E, a resistance member 164 may be used instead of the resistance member 16 of each embodiment. A plurality of resistance members 164 are provided in the stacking direction H to be separated from each other. The material and surface shape of the resistance member 164 may be the same as those of the resistance member 16 and each of the above-described modifications.

The number and arrangement interval of the resistance members 164 in the loading direction H are not particularly limited.

According to the resistance member 164 of the present modification, the state of being in contact with the resistance member 164 and the state of being not in contact with the resistance member 164 are repeated while the sheet S is ascending and descending. When the sheet S is in contact with the resistance member 164, the sheet S receives sliding resistance, and when the sheet S is not in contact with the resistance member 164, the sheet S does not receive sliding resistance, and thus the change in sliding resistance along the stacking direction H is large. As a result, in the modification, the sheet S can be separated more efficiently.

Figure 25F:
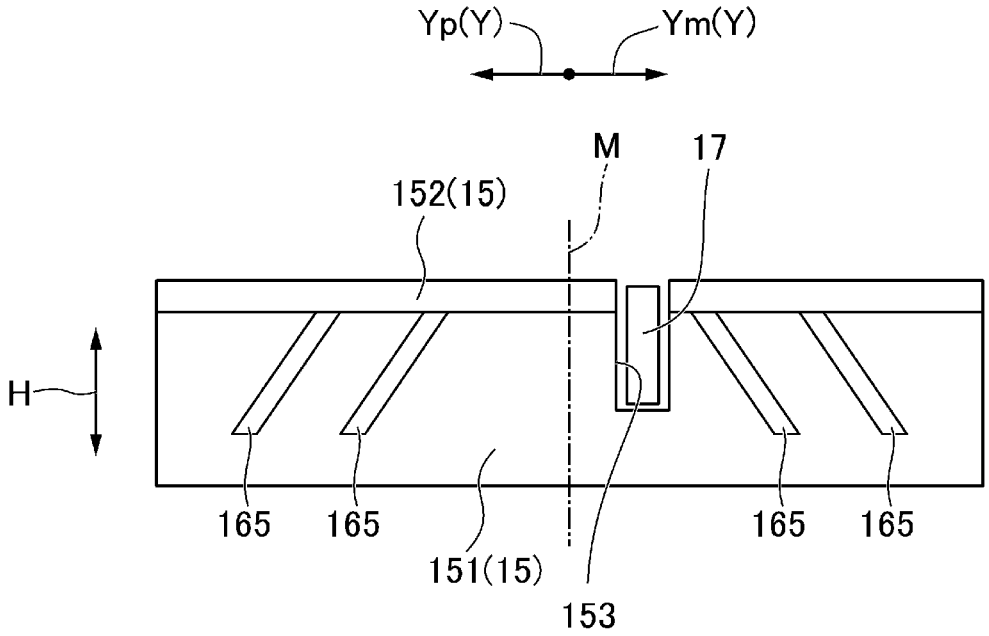
FIG. 25F is a schematic diagram of a modification (sixth modification) of the resistance member in the sheet conveying device of the first embodiment as viewed from the conveyance direction.

FIG. 25F is a schematic diagram of a modification (sixth modification) of the resistance member in the sheet conveying device of the first embodiment as viewed from the conveyance direction.

As shown in FIG. 25F, a resistance member 165 may be used instead of the resistance member 16 of the first embodiment. While the resistance member 16 is provided along the stacking direction H, the resistance member 165 is arranged to be inclined toward the conveyance center line M as advancing upward in the stacking direction H.

According to the resistance member 165 of the present modification, since the contact position with the resistance member 165 changes in the Y direction while the sheet S moves up and down, the sheet S can be separated more efficiently.

In particular, when the sheet S descends with a large separating force, since the sheet S is separated toward the outside in the width direction of the sheet S, both sides of the sheet S in the width direction are well separated.

The modification may be applied to the second and third embodiments.

Figure 25G:
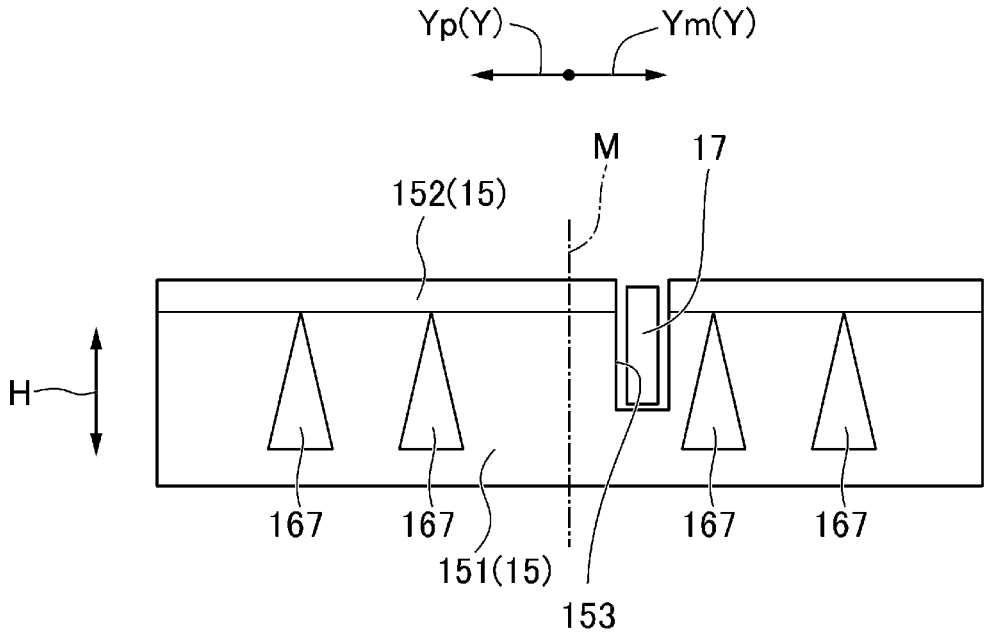
FIG. 25G is a schematic diagram of a modification (seventh modification) of the resistance member in the sheet conveying device of the first embodiment as viewed from the conveyance direction.

FIG. 25G is a schematic diagram of a modification (seventh modification) of the resistance member in the sheet conveying device of the first embodiment as viewed from the conveyance direction.

As shown in FIG. 25G, a resistance member 166 may be used instead of the resistance member 16 of the first embodiment. While the resistance member 16 has a constant width w along the stacking direction H, the resistance member 166 has a width that decreases toward the upper side in the stacking direction H. In FIG. 25G, the resistance member 166 has a triangular shape but may have a trapezoidal shape whose width becomes narrower toward the upper side.

According to the resistance member 166 of the present modification, since the resistance member 166 and the width thereof become narrower toward the upper side in the stacking direction H, the change in the sliding resistance between the ascending time and the descending time is different.

In the modification, the sliding resistance is increased during descending when the separating force is increased, and therefore, the separation is more strongly performed when descending.

The modification may be applied to the second and third embodiments.

In each embodiment, an example in which the sheet conveying device is used in an image processing apparatus that performs image formation is described, but the sheet conveying device may be used in an image processing apparatus that does not perform image formation. For example, the sheet conveying device may be used in an image processing apparatus that erases an image formed with a decolorable toner by heating, light irradiation, or the like.

The sheet conveying device may be used in an apparatus other than the image processing apparatus as long as the apparatus uses sheets that are preferably subjected to the separation.

In the first embodiment, an example of the elevating mechanism 40 including a cam was described, but the elevating mechanism 40 is not limited to a device configuration including a camas long as the elevating plate 13 can be lifted and lowered.

In the third embodiment, the example in which the lower space R is formed by the sheet feed cassette 81 having the inclined bottom surface portion 811 was described. However, the shape of the lower space R is not particularly limited as long as the elevating plate 202 can descend to the second lowered position. For example, instead of the inclined bottom surface portion 811, a stepped bottom surface portion lower than the bottom surface portion 201 may be provided.

An image processing apparatus and a sheet conveying device of a modification (eighth modification) of the second embodiment will be described.

As shown in FIG. 1, an image processing apparatus 103 according to the modification (eighth modification) of the second embodiment includes a sheet supply unit 90 (sheet conveying device) and a control circuit 63 instead of the sheet supply unit 70 and the control circuit 62 of the image processing apparatus 102 according to the second embodiment. The sheet supply unit 90 is an example of the sheet conveying device according to the modification of the second embodiment.

Figure 26:
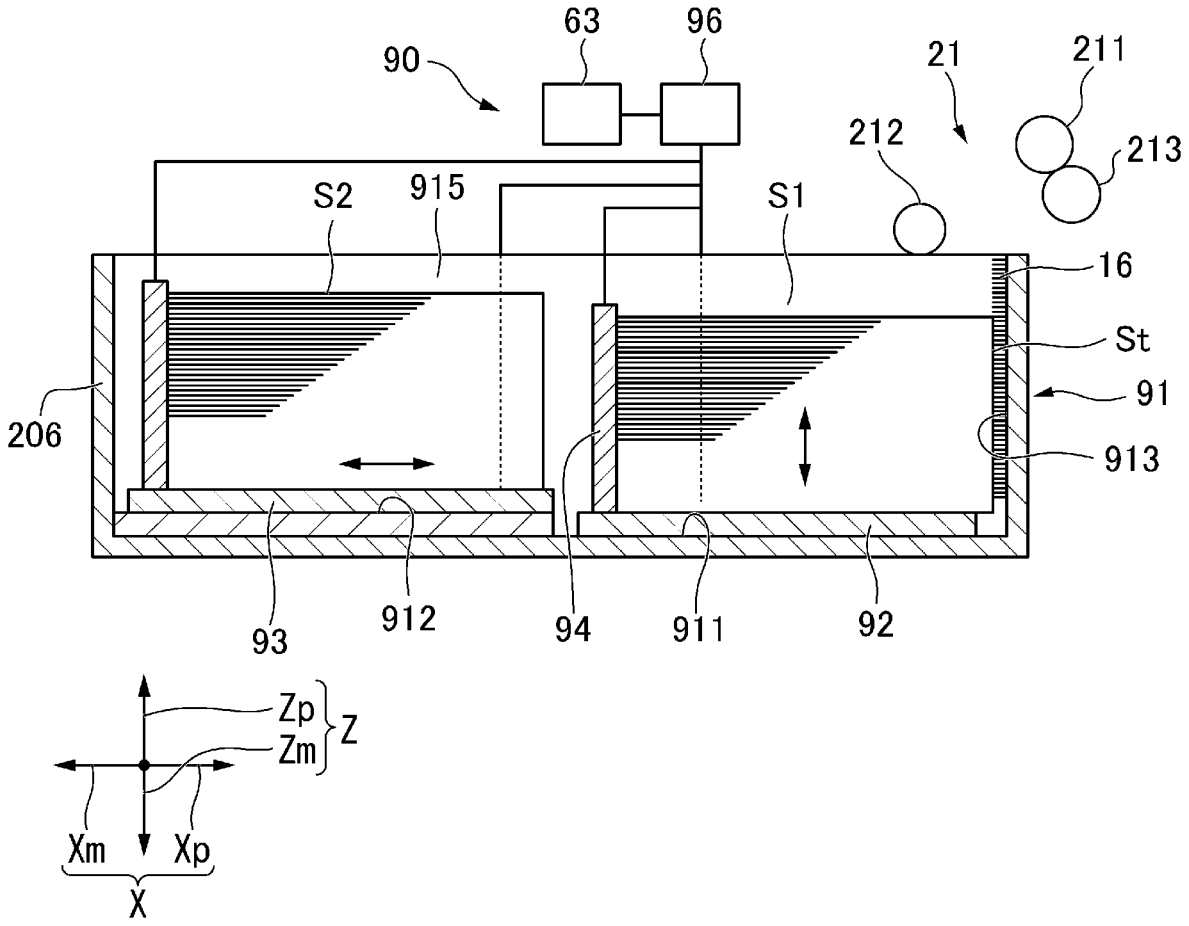
FIG. 26 is a schematic diagram of a cross section of a sheet conveying device according to a modification (eighth modification) of the second embodiment.

FIG. 26 is a schematic diagram of a cross section of a sheet conveying device according to a modification (eighth modification) of the second embodiment.

As shown in FIG. 26, the sheet supply unit 90 is a tandem-type sheet feeding device capable of arranging a first sheet bundle formed of a plurality of sheets S1 and a second sheet bundle formed of a plurality of sheets S2. The first sheet bundle and the second sheet bundle are adjacent to each other in the conveyance direction of the cassette sheet feed unit 21.

The conveyance direction in the cassette sheet feed unit 21 of the present modification is the Xp direction, as in the second embodiment.

The sheet supply unit 90 includes a sheet feed cassette 91 and a sheet bundle moving mechanism 96 (moving mechanism, elevating mechanism).

The sheet feed cassette 91 is a box type that opens in the Zp direction, similar to the sheet feed cassette 20 in the second embodiment. The sheet feed cassette 91 has a bottom surface portion 911 and a plurality of walls extending in the Zp direction from the outer edge of the bottom surface portion 911.

On the bottom surface portion 911, an elevating plate 92 (tray) is arranged closer to the Xp direction side than the center in the X direction.

On the bottom surface portion 911, a guide unit 912 and a moving tray 93 are arranged closer to the Xm direction side than the center in the X direction.

A plurality of sheets S1 or a plurality of sheets S2 transferred from the moving tray 93 described later can be placed on the elevating plate 92. The elevating plate 92 is a flat plate extending parallel to the ZX plane. The elevating plate 92 is provided to be movable in parallel in the Z direction in the space inside the sheet feed cassette 91 above the upper surface of the bottom surface portion 911. The elevating plate 92 can be lifted and lowered between the lowest first lowered position shown in FIG. 26 and the uppermost position where the upper surface can contact the pickup roller 212.

The guide unit 912 is arranged on the bottom surface portion 911 and supports the moving tray 93 from below. The guide unit 912 supports the moving tray 93 to be movable in the X direction. The guide unit 912 supports the moving tray 93 to be movable in the X direction between a first position displaced in the Xm direction (a direction opposite to the conveyance direction) from the elevating range of the elevating plate 92, and a second position above the elevating plate 92 that moved to the first lowered position.

The moving tray 93 supports a plurality of sheets S2 from below. The size of the sheet S2 that can be placed on the moving tray 93 is equal to or smaller than the maximum size of the sheet S1 that can be stacked on the elevating plate 92. The moving tray 93 is guided by the guide unit 912 and can reciprocate between the first position and the second position.

The plurality of walls include a front end wall 913 (regulation plate) instead of the front end wall 203 of the sheet feed cassette 20 in the second embodiment. The plurality of walls include two side walls 915 instead of the front side wall 204 and the rear side wall 205 of the sheet feed cassette 20.

The front end wall 913 is similar to the front end wall 203, except that the conveyance guide plate 2031 is not included. The resistance member 16 is provided on the surface of the front end wall 913 in the Xm direction, as in the second embodiment. The front end wall 913 is an example of a regulation plate that regulates the position of the leading end of the sheet S1 in the conveyance direction.

The two side walls 915 are arranged with a space wider than the width of the elevating plate 92 and the moving tray 93 in the Y direction. A stopper 94 is arranged inside each side wall 915.

The stopper 94 is selectively switched between a state of advancing inward from the outside of the conveyance path of the moving tray 93 and a state of being retracted from the conveyance path.

When each stopper 94 advances, each stopper 94 abuts the ends of the plurality of sheets S1 on the elevating plate 92 in the Xm direction over the entire stacking direction. When the stoppers 94 are retracted, a space is provided between the stoppers 94 so that the moving tray 93 and the plurality of sheets S2 moving together with the moving tray 93 can pass through.

The configuration of the stopper 94 is not particularly limited. For example, the stopper 94 may be a plate movably supported in the Y direction or a plate rotatably supported in the YZ plane.

The sheet bundle moving mechanism 96 moves the elevating plate 92, the moving tray 93, and each stopper 94 within their respective movable ranges. The sheet bundle moving mechanism 96 includes a motor that lifts and lowers the elevating plate 202, and a drive transmission mechanism that transmits the driving force of the motor to the elevating plate 202. The sheet bundle moving mechanism 96 includes a motor that moves the moving tray 93 in the X direction, and a drive transmission mechanism that transmits the driving force of the motor to the moving tray 93. The sheet bundle moving mechanism 96 includes a motor or a solenoid that moves each stopper 94 forward and backward.

The sheet bundle moving mechanism 96 is communicatively connected to the control circuit 63. The sheet bundle moving mechanism 96 drives the elevating plate 92, the moving tray 93, and each stopper 94 based on a control signal from the control circuit 63.

The sheet bundle moving mechanism 96 is an example of an elevating mechanism that lifts and lowers the elevating plate 92 in the stacking direction of the plurality of sheets S1.

The sheet bundle moving mechanism 96 is an example of a moving mechanism that moves the moving tray 93 from the first position to the second position and places the plurality of sheets S2 on the elevating plate 92 when the elevating plate 92 is descending.

Similar to the control circuit 61 in the second embodiment, the control circuit 63 controls the entire image processing apparatus 103. The control circuit 63 is the same as the control circuit 61 in the second embodiment, except that the control circuit 63 transmits a control signal to the sheet bundle moving mechanism 96 to perform a transfer operation of transferring the plurality of sheets S2 on the moving tray 93 onto the elevating plate 92.

However, the control circuit 63 transmits a control signal to the sheet bundle moving mechanism 96 to lift and lower the elevating plate 92, thereby causing the plurality of sheets arranged on the elevating plate 92 to be separated.

The transfer operation will be briefly described. In the transfer operation, the control circuit 63 transmits a control signal to the sheet bundle moving mechanism 96 to perform the following operation.

When the control circuit 63 detects that all of the plurality of sheets S1 were conveyed from the elevating plate 92 in the same manner as in the second embodiment, the control circuit 63 lowers the elevating plate 92 to the first lowered position and retracts the stoppers 94. After that, the control circuit 63 moves the moving tray 93 from the first position to the second position. After that, the control circuit 63 advances each stopper 94. Each stopper 94 is locked to the ends of the plurality of sheets S2 on the moving tray 93 in the Xm direction.

After that, the control circuit 63 moves the moving tray 93 from the second position to the first position. Here, since the ends of the plurality of sheets S2 in the Xm direction are supported by the stoppers 94, only the moving tray 93 moves to the first position. The plurality of sheets S2 drop onto the elevating plate 92.

Thus, the transfer operation is completed.

The separating operation in the sheet supply unit 90 is the same as that in the second embodiment, except that the sheet bundle moving mechanism 96 lifts and lowers the elevating plate 92 at least once between the first lowered position and the lifted position.

In the separating operation of the modification, the leading end St of the sheet arranged on the elevating plate 92 moves in parallel in the Z direction in the state of being in contact with the resistance member 16. Therefore, for example, even when the number of sheets stacked on the elevating plate 92 is large, uniform separation is performed in the stacking direction.

The separating operation in the modification may be performed at any time from when a plurality of sheets are arranged on the elevating plate 92 to when the sheets are fed by the cassette sheet feed unit 21. For example, the control circuit 63 may execute the separating operation immediately after the transfer is completed or may execute the separating operation after receiving the print start signal.

According to at least one embodiment described above, since the sheet conveying device includes a tray that stacks a plurality of sheets, an elevating mechanism that lifts and lowers the tray in the stacking direction of the plurality of sheets, a conveyance roller that conveys the plurality of sheets in the conveyance direction from the upper side in the stacking direction, and a resistance member imparting a sliding resistance larger than that of the sheet stacking surface of the tray to the leading ends of the plurality of sheets that are lifted and lowered by the elevating mechanism, it is possible to provide a sheet conveying device capable of preventing double feeding even if the user does not separate a plurality of sheets before placing the sheets S.

While certain embodiments have been described, these embodiments have been presented by way of example only, and are not intended to limit the scope of the inventions. Indeed, the novel embodiments described herein may be embodied in a variety of other forms: furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet conveying device, comprising:

a tray configured to accommodate a stack of a plurality of sheets;

an elevating mechanism configured to lift and lower the tray in a stacking direction of the plurality of sheets;

a conveyance roller configured to convey one sheet at a time from the plurality of sheets in the conveyance direction from the upper side in the stacking direction; and a resistance member in contact with a leading end of the plurality of sheets in the conveyance direction and configured to impart a sliding resistance larger than a sliding resistance of a sheet stacking surface of the tray to the leading ends of the plurality of sheets that are lifted and lowered by the elevating mechanism, wherein the resistance member comprises a surface layer portion that comes into contact with the plurality of sheets and the surface layer portion is non-smooth in the stacking direction and the resistance member has a napped material comprising a plurality of fibers extending toward the plurality of sheets on the surface layer portion.

2. The device according to claim 1, wherein the resistance member has a surface in contact with the plurality of sheets and the surface has a friction coefficient larger than a friction coefficient of the sheet stacking surface.

3. The device according to claim 2, wherein the resistance member has conductivity.

4. The device according to claim 1, wherein the resistance member has conductivity.

5. The device according to claim 1, wherein the elevating mechanism lifts and lowers the tray between a first lowered position where the plurality of sheets is set and a lifted position above the first lowered position in the stacking direction and capable of abutting upper ends of the plurality of sheets against the conveyance roller, and the resistance member is arranged at a position contacting the leading end of the plurality of sheets in at least a part of the elevating range of the tray.

6. The device according to claim 5, wherein the resistance member has conductivity.

7. The device according to claim 5, wherein the elevating mechanism configured to descend to a second lowered position located below the first lowered position in the stacking direction and move the tray from the second lowered position toward the lifted position.

8. The device according to claim 5, further comprising:

a control circuit configured to control the conveyance roller and the elevating mechanism, wherein the control circuit causes the elevating mechanism to lift and lower the tray at least once in an elevating range in which the plurality of sheets come into contact with the resistance member and then to move the tray to the lifted position, and then, drive the conveyance roller to start the conveyance of the plurality of sheets.

9. The device according to claim 1, wherein the tray stacks a first sheet bundle comprising a plurality of sheets so that the leading end of the first sheet bundle abuts the resistance member and the first sheet bundle can be lifted and lowered, and the device further comprises a moving tray configured to be movable between a first position in the direction opposite to the conveyance direction with respect to the tray and a second position on the upper side of the tray to place a second sheet bundle formed of a plurality of sheets, and a moving mechanism configured to move the moving tray from the first position to the second position and place the second sheet bundle on the tray when the tray is descending by the elevating mechanism.

10. An image processing apparatus, comprising:

an image forming device; and a sheet conveying device comprising:

a tray configured to accommodate a stack of a plurality of sheets;

an elevating mechanism configured to lift and lower the tray in a stacking direction of the plurality of sheets;

a conveyance roller configured to convey one sheet at a time from the plurality of sheets in the conveyance direction from the upper side in the stacking direction; and a resistance member in contact with a leading end of the plurality of sheets in the conveyance direction and configured to impart a sliding resistance larger than a sliding resistance of a sheet stacking surface of the tray to the leading ends of the plurality of sheets that are lifted and lowered by the elevating mechanism, wherein the resistance member comprises a surface layer portion that comes into contact with the plurality of sheets and the surface layer portion is non-smooth in the stacking direction, the resistance member has a napped material comprising a plurality of fibers extending toward the plurality of sheets on the surface layer Portion.

11. The apparatus according to claim 10, wherein the resistance member has conductivity.

12. The apparatus according to claim 10, wherein the resistance member has a surface in contact with the plurality of sheets and the surface has a friction coefficient larger than a friction coefficient of the sheet stacking surface.

13. A sheet conveying method, comprising:

lifting and lowering a tray configured to accommodate a stack of a plurality of sheets in a stacking direction of the plurality of sheets using an elevating mechanism;

conveying one sheet at a time from the plurality of sheets in the conveyance direction from the upper side in the stacking direction; and contacting a resistance member with a leading end of the plurality of sheets in the conveyance direction and imparting a sliding resistance larger than a sliding resistance of a sheet stacking surface of the tray to the leading ends of the plurality of sheets that are lifted and lowered by the elevating mechanism, wherein the resistance member comprises a surface layer portion that comes into contact with the plurality of sheets and the surface layer portion is non-smooth in the stacking direction, and the resistance member has a napped material comprising a plurality of fibers extending toward the plurality of sheets on the surface layer portion.

14. The method according to claim 13, wherein the resistance member has conductivity.

15. The method according to claim 13, wherein the resistance member has a surface in contact with the plurality of sheets and the surface has a friction coefficient larger than a friction coefficient of the sheet stacking surface.

16. The method according to claim 15, wherein the resistance member has conductivity.

17. The method according to claim 13, further comprising:

lifting and lowering the tray between a first lowered position where the plurality of sheets is set and a lifted position above the first lowered position in the stacking direction and abutting upper ends of the plurality of sheets against the conveyance roller; and contacting the leading end of the plurality of sheets in at least a part of the elevating range of the tray.

18. The method according to claim 17, further comprising:

descending the elevating mechanism to a second lowered position located below the first lowered position in the stacking direction and moving the tray from the second lowered position toward the lifted position.

19. The method according to claim 17, further comprising:

lifting and lowering the tray at least once in an elevating range in which the plurality of sheets come into contact with the resistance member and then moving the tray to the lifted position, and then, driving the conveyance roller to start the conveyance of the plurality of sheets.

20. The method according to claim 13, wherein the tray stacks a first sheet bundle comprising a plurality of sheets so that the leading end of the first sheet bundle abuts the resistance member and the first sheet bundle can be lifted and lowered, and further comprising:

moving a moving tray between a first position in the direction opposite to the conveyance direction with respect to the tray and a second position on the upper side of the tray to place a second sheet bundle formed of a plurality of sheets; and moving the moving tray from the first position to the second position and placing the second sheet bundle on the tray when the tray is descending.

* * * * *